US008313882B2

(12) United States Patent
Tsubaki et al.

(10) Patent No.: US 8,313,882 B2
(45) Date of Patent: Nov. 20, 2012

(54) TONER AND TWO-COMPONENT DEVELOPER

(75) Inventors: Yoritaka Tsubaki, Osaka (JP); Yoshitaka Kawase, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 290 days.

(21) Appl. No.: 12/720,152

(22) Filed: Mar. 9, 2010

(65) Prior Publication Data

US 2010/0233611 A1 Sep. 16, 2010

(30) Foreign Application Priority Data

Mar. 10, 2009 (JP) ..... P2009-057197

(51) Int. Cl.
*G03G 9/093* (2006.01)

(52) U.S. Cl. ..... 430/110.2; 430/110.1

(58) Field of Classification Search ..... 430/110.1, 430/110.2

See application file for complete search history.

(56) References Cited

U.S. PATENT DOCUMENTS

| | | | | |
|---|---|---|---|---|
| 7,396,628 | B2 | 7/2008 | Ninomiya et al. | |
| 2006/0210899 | A1 | 9/2006 | Nakazawa et al. | |
| 2006/0210904 | A1 * | 9/2006 | Ninomiya et al. | 430/110.2 |
| 2008/0063970 | A1 | 3/2008 | Kikawa et al. | |
| 2008/0166156 | A1 | 7/2008 | Kawase et al. | |
| 2009/0011357 | A1 | 1/2009 | Kawase et al. | |
| 2009/0136863 | A1 * | 5/2009 | Asarese et al. | 430/108.1 |

FOREIGN PATENT DOCUMENTS

| | | | |
|---|---|---|---|
| CN | 1834794 | A | 9/2006 |
| JP | 2004-151638 | | 5/2004 |
| JP | 2004-233650 | | 8/2004 |
| JP | 2006-293273 | | 10/2006 |
| JP | 2008-65.180 | A | 3/2008 |
| JP | 2008-191639 | A | 8/2008 |
| JP | 2008-268353 | | 11/2008 |
| JP | 2009-15175 | A | 1/2009 |

* cited by examiner

*Primary Examiner* — Peter Vajda
(74) *Attorney, Agent, or Firm* — Nixon & Vanderhye P.C.

(57) ABSTRACT

There are provided a toner and a two-component developer effective to make exudation of a release agent easy during fixing and to prevent occurrence of high-temperature offset, in which both the preservation stability and the fixing property are improved at the same time. The capsule toner comprises a toner base particle and a resin layer formed of fine resin particles with which a surface of the toner base particle is coated. In the capsule toner, both of the following expressions are satisfied:

$$A<B; \text{ and } (B-A)<3\times10^3 Pa$$

where A is a storage elastic modulus of the toner base particle at a softening temperature of the toner base particle, and B is a storage elastic modulus of fine resin particle at the softening temperature of the toner base particle.

6 Claims, 6 Drawing Sheets

TONER AND TWO-COMPONENT DEVELOPER

CROSS-REFERENCE TO RELATED APPLICATION

This application claims priority to Japanese Patent Application No. 2009-057197, which was filed on Mar. 10, 2009, the contents of which are incorporated herein by reference in its entirety.

BACKGROUND OF THE INVENTION

1. Field of the Invention

The present invention relates to a toner and a two-component developer.

2. Description of the Related Art

As a method for manufacturing a toner, a kneading and pulverization method is conventionally used. However, the pulverized toner particles are amorphous-shaped whose surfaces have a plurality of concavity and convexity. Since the fracture plane after pulverization directly becomes a toner particle surface, the surface composition of the toner particle easily becomes so nonuniform that it is difficult to control the surface condition to be uniform. When the toner particle surface is amorphous-shaped because of the plurality of concavity and convexity, problems are posed such that the flowability of the toner is degraded, fogging and toner spattering due to the nonuniformity of the toner composition is caused, and so on.

In view of such problems related to the amorphous-shape of the toner particle surface, instead of a kneading and pulverization method, a variety of methods for manufacturing a toner are proposed such as a wet method comprising mixing dispersion liquid of toner materials and aggregating the materials. However, in case of a wet method, since a dispersion stabilizer and an aggregating agent are heavily used, a part of their components remains on a toner particle surface or inside a toner particle, resulting in disadvantages to cause decrease of humidity resistance and degradation of chargeability, in particular, to easily cause the chargeability to be highly unstable.

Among properties required of toner, chargeability is particularly important, which significantly effects behavior and quality in development and transferability (control of color toning process and transfer process, and so on).

On the other hand, according to recent trends of high-quality imaging, downsizing of particle size of a toner is progressed and content percentage of a finely-divided toner having small particle size tends to be increased. In a two-component developer comprising a toner having small particle size, crack and shape change of the toner having small particle size caused by a stress in a developing apparatus cause toner spent on a carrier along with degradation of chargeability of the developer, which trigger degradation of image quality.

Further, according to recent trends of colorization, low-temperature fixing of a color toner is progressed and a toner whose component is softened at low temperature tends to be used.

Accordingly, a capsule toner is proposed as the toner having excellent flowability, transferability and the like, uniform chargeability, advanced offset resistance, and various capabilities other than the above, in which a surface of a toner base particle is coated with a resin layer.

In Japanese Unexamined Patent Publication JP-A 2006-293273, a toner is proposed which has core shell structure such that storage elastic moduli of a core layer and a shell layer have a predetermined ratio.

However, the storage elastic modulus of the shell layer of the toner disclosed in JP-A 2006-293273 is so greater than that of the core layer that exudation of the release agent during fixing is not easy, with the result that high-temperature offset phenomenon may occur.

SUMMARY OF THE INVENTION

An object of the invention is to provide a toner and a two-component developer effective to make exudation of a release agent easy during fixing and to prevent occurrence of high-temperature offset, in which both preservation stability as well as fixing property is improved.

The invention provides a capsule toner comprising a toner base particle and a resin layer formed of fine resin particles with which a surface of the toner base particle is coated, both of the following expressions being satisfied:

$$A<B;\ \text{and}\ (B-A)<3\times10^3 Pa \quad (1)$$

where A is a storage elastic modulus of the toner base particle at a softening temperature of the toner base particle, and B is a storage elastic modulus of the fine resin particle at the softening temperature of the toner base particle.

According to the invention, in the capsule toner, the storage elastic modulus of the toner base particle and the storage elastic modulus of the fine resin particle forming the resin layer satisfy the expressions (1) as described above. In the capsule toner, in a case where a difference between the storage elastic modulus of the toner base particle and the storage elastic modulus of the fine resin particle is large, a problem is posed such that even when the release agent melts during fixing, the resin layer becomes a wall, thereby the exudation of the release agent is not so easy that high-temperature offset phenomenon easily occurs. Further, in a case where the storage elastic modulus of the toner base particle and the storage elastic modulus of the fine resin particle are the same, that is, the same types of resin are used lowering of a glass transition temperature (Tg) for a low-temperature fixing poses a problem that the preservation stability of the toner degrades. According to the capsule toner in which the storage elastic modulus of the toner base particle and the storage elastic modulus of the fine resin particle satisfy the above expressions (1), it is possible to improve the low-temperature fixing property, the preservation stability and the broad offset region of the toner at the same time without preventing exudation of the release agent during fixing of the toner.

Further, in the invention, it is preferable that the storage elastic modulus A and the storage elastic modulus satisfy both of the following expressions:

$$A<B;\ \text{and}\ (B-A)<1\times10^3 Pa \quad (2).$$

According to the invention, in the capsule toner, the storage elastic modulus of the toner base particle and the storage elastic modulus of the fine resin particle satisfy the expressions (2) as described above. When the storage elastic modulus A and the storage elastic modulus B satisfy the expressions (2), it is possible to further improve an exudation effect of the release agent during fixing of the toner and the preservation stability of the toner.

Further, in the invention, it is preferable that the capsule toner is manufactured by a method comprising a fine resin particle adhering step of adhering the fine resin particles to the surface of the toner base particle which has been produced through a pulverization method, a spraying step of spraying a liquid with carrier gas from a spraying section to the toner base particle and the fine resin particles in a fluidized state to plasticize these particles, and a film-forming step of continuing rotating by a rotary stirring section to fluidize the toner base particle and the fine resin particles until the fine resin particles adhered to the toner base particle are softened to form a film.

According to the invention, by manufacturing the toner through the above method, it is possible to select materials of the toner base particle and the fine resin particle from a wide range, and to uniformly coat the toner base particle with the fine resin particles.

Further, in the invention, it is preferable that an addition amount of the fine resin particle at the fine resin particle adhering step is 5 parts by weight or more based on 100 parts by weight of the toner base particle.

According to the invention, at a manufacturing process of the capsule toner, by setting the addition amount of the fine resin particle to 5 parts by weight or more, it is possible to uniformly coat the toner base particle, and to further improve the exudation effect of the release agent during fixing of the toner and the preservation stability of the toner.

Further, in the invention, it is preferable that a glass transition temperature of the fine resin particle is 60° C. or higher.

According to the invention, by setting the glass transition temperature of the fine resin particle to 60° C. or higher, it is possible to further improve the preservation stability of the toner.

Further, the invention provides a two-component developer comprising the capsule toner mentioned above and a carrier.

According to the invention, it is possible to obtain a developer which keeps the flowability excellent, has sufficient development performance, and is capable of forming a high-quality image, by comprising the capsule toner that achieves the low-temperature fixing property, the preservation stability and the broad offset region of the toner at the same time without preventing the exudation of the release agent during fixing of the toner.

BRIEF DESCRIPTION OF THE DRAWINGS

Other and further objects, features, and advantages of the invention will be more explicit from the following detailed description taken with reference to the drawings wherein.

DETAILED DESCRIPTION

Figure 1:
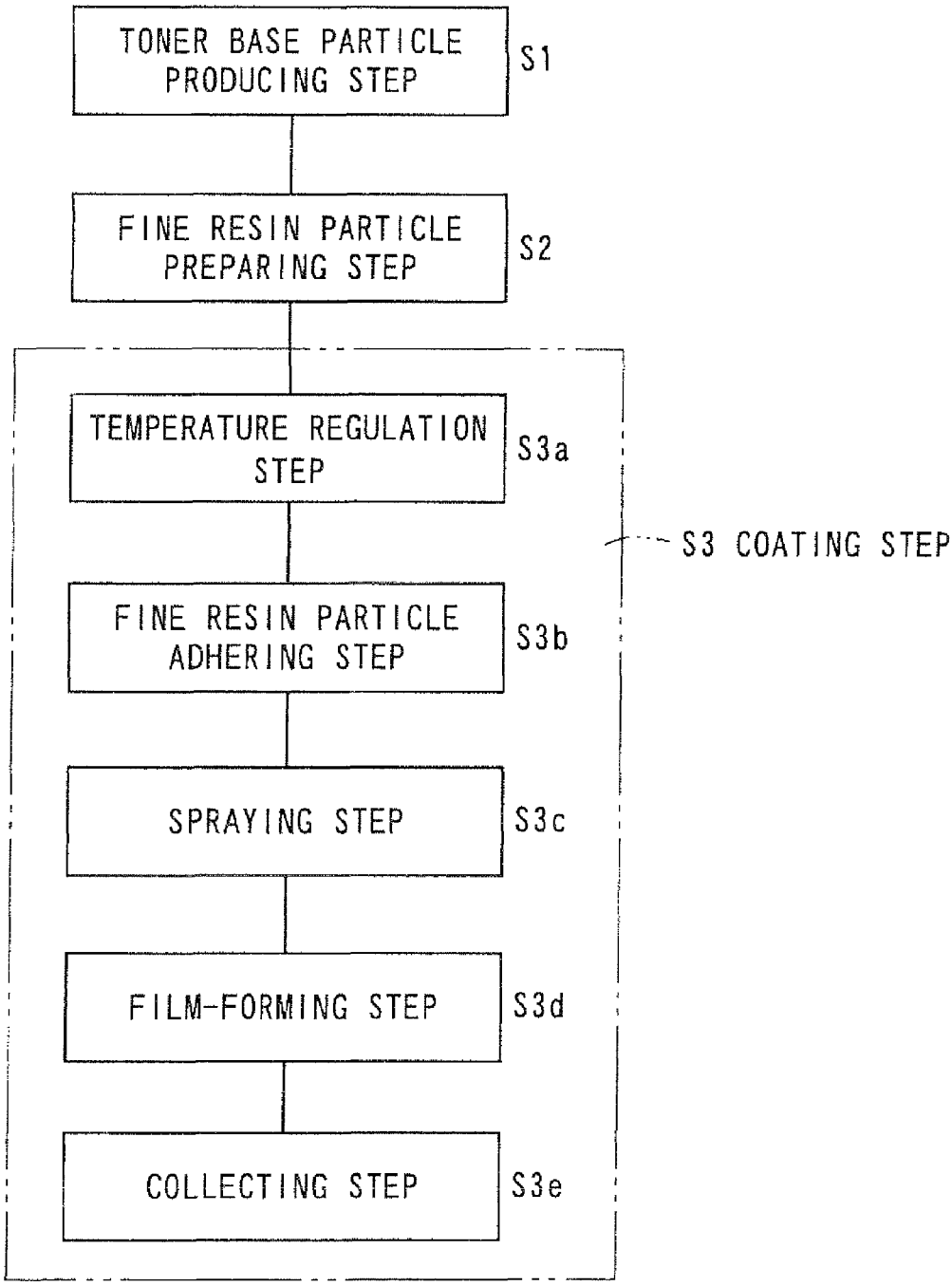
FIG. 1 is a flowchart of an example of a procedure for a method for manufacturing a toner according to an embodiment.

Now referring to the drawings, preferred embodiments of the invention are described below.

1. Method for Manufacturing Toner

FIG. 1 is a flowchart showing one example of a procedure of a method for manufacturing a toner according to an embodiment of the invention. The method for manufacturing a toner of the invention comprises a toner base particle producing step S1 of producing toner base particles, a fine resin particle preparing step S2 of preparing fine resin particles; and a coating step S3 of coating the toner base particle with the fine resin particles.

(1) Toner Base Particle Producing Step S1

At the toner base particle producing step S1, toner base particles to be coated with resin layers are produced. The toner base particle is a particle containing binder resin and a colorant, and a method for producing the toner base particles can be performed by a known method without particular limitation. Examples of the method for producing the toner base particles include a dry method such as a pulverization method, and a wet method such as a suspension polymerization method, an emulsion aggregation method, a dispersion polymerization method, a dissolution suspension method and a melting emulsion method. The method for producing the toner base particles using a pulverization method will be described below.

(Production of Toner Base Particles by a Pulverization Method)

In producing toner base particles by a pulverization method, a toner composition containing binder resin, a colorant and other additive is dry-mixed by a mixer, and thereafter melt-kneaded by a kneading machine. A kneaded material obtained by the melt-kneading is cooled and solidified, and then a solidified material is pulverized by a pulverizing machine. Subsequently, a resultant material is treated with particle size adjustment such as classification according to need. The toner base particles are thus obtained.

Usable mixers include heretofore known mixers including, for example, a Henschel-type mixing apparatus such as HENSCHEL MIXER (trade name, manufactured by Mitsui Mining Co., Ltd.), SUPERMIXER (trade name, manufactured by Kawata MFG Co., Ltd.), and MECHANOMILL (trade name, manufactured by Okada Seiko Co., Ltd.), ANGMILL (trade name, manufactured by Hosokawa Micron Corporation), HYBRIDIZATION SYSTEM (trade name, manufactured by Nara Machinery Co., Ltd.), and COSMOSYSTEM (trade name, manufactured by Kawasaki Heavy Industries, Ltd.)

Usable kneaders also include heretofore known kneaders including, for example, a commonly-used kneader such as a twin-screw extruder, a three roll mill, and a laboplast mill. Specific examples of such kneaders, for example, include a single or twin screw extruder such as TEM-100B (trade name, manufactured by Toshiba Machine Co., Ltd.), PCM-65/87 and PCM-30 (both of which are trade names and manufactured by Ikegai, Ltd.), and open roll-type kneading machines such as KNEADEX (trade name, manufactured by Mitsui Mining Co., Ltd.) Among them, the open roll-type kneading machine is preferable.

Examples of the pulverizing machine, for example, include a jet pulverizing machine that performs pulverization using ultrasonic jet air stream, and an impact pulverizing machine that performs pulverization by guiding a solidified material to a space formed between a rotor that is rotated at high speed and a stator (liner).

For the classification, a known classifying machine capable of removing excessively pulverized toner base particles by classification with a centrifugal force and a wind force is usable, and an example thereof includes a revolving type wind-force classifying machine (rotary type wind-force classifying machine).

(Raw Material of Toner Base Particle)

As described above, the toner base particle contains a binder resin and a colorant. The binder resin is not particularly limited and any known binder resin used for a black toner or a color toner is usable, and examples thereof include styrene resins such as polystyrene and styrene-acrylic acid ester copolymer resin, acrylic resins such as polymethylmethacrylate, polyolefin resins such as polyethylene, polyester, polyurethane, and epoxy resin. Further, a resin obtained from a polymerization reaction by mixing a raw monomer mixture material and a release agent may be used. The binder resins may be used each alone, or two or more of them may be used in combination.

Among the above types of binder resin, polyester is preferable as binder resin for a color toner because it provides advanced transparency as well as excellent powder flowability, low-temperature fixing property, secondary color reproducibility and the like to toner particles. As polyester, heretofore known substances may be used including, for example, a polycondensation product from a polybasic acid and a polyvalent alcohol.

As the polybasic acid, substances known as monomer for polyester can be used including, for example: aromatic carboxylic acids such as terephthalic acid, isophthalic acid, phthalic anhydride, trimellitic anhydride, pyromellitic acid, and naphthalene dicarboxylic acid; aliphatic carboxylic acids such as maleic anhydride, fumaric acid, succinic acid, alkenyl succinic anhydride, and adipic acid; and methyl-esterified compounds of the polybasic acids. The polybasic acids may be used each alone, or two or more of them may be used in combination.

As the polyvalent alcohol, substances known as monomers for polyester can also be used including, for example: aliphatic polyvalent alcohols such as ethylene glycol, propylene glycol, butanediol, hexanediol, neopentyl glycol, and glycerin; alicyclic polyvalent alcohols such as cyclohexanediol, cyclohexanedimethanol, and hydrogenated bisphenol A; and aromatic diols such as ethylene oxide adduct of bisphenol A and propylene oxide adduct of bisphenol A. The polyvalent alcohols may be used each alone, or two or more of them may be used in combination.

The polybasic acid and the polyvalent alcohol can undergo polycondensation reaction in an ordinary manner, that is, for example, the polybasic acid and the polyvalent alcohol are brought into contact with each other in the presence or absence of organic solvent and in the presence of polycondensation catalyst. The polycondensation reaction ends when an acid number, a softening temperature, etc. of the polyester to be produced reach predetermined values. The polyester is thus obtained.

When the methyl-esterified compound of the polybasic acid is used as part of the polybasic acid, dimethanol polycondensation reaction is caused. In the polycondensation reaction, a compounding ratio, a reaction yield, etc. of the polybasic acid and the polyvalent alcohol are appropriately modified, making it possible to, for example, adjust a content of carboxyl end groups in the polyester and thus allowing for denaturation of the polyester to be obtained. The denatured polyester can be obtained also by simply introducing a carboxyl group to a main chain of the polyester with use of trimellitic anhydride as the polybasic acid. Note that polyester self-dispersible in water may also be used which polyester has a main chain and/or side chain bonded to a hydrophilic group such as a carboxyl group or a sulfonate group. Further, the polyester may be grafted with acrylic resin.

It is preferred that the binder resin has a glass transition temperature of 30° C. or higher and 80° C. or lower. The binder resin having a glass transition temperature lower than 30° C. easily causes the blocking in which the toner particles thermally aggregate inside an image forming apparatus, which may decrease the preservation stability. The binder resin having a glass transition temperature higher than 80° C. lowers the fixing property of the toner onto a recording medium, which may cause a fixing failure.

As the colorant, it is possible to use an organic dye, an organic pigment, an inorganic dye, an inorganic pigment or the like which is customarily used in the electrophotographic field.

Examples of black colorant include carbon black, copper oxide, manganese dioxide, aniline black, activated carbon, non-magnetic ferrite, magnetic ferrite, and magnetite.

Examples of yellow colorant include chrome yellow, zinc yellow, cadmium yellow, yellow iron oxide, mineral fast yellow, nickel titanium yellow, navel yellow, naphthol yellow S, hanza yellow G, hanza yellow 10G, benzidine yellow G, benzidine yellow GR, quinoline yellow lake, permanent yellow NCG, tartrazine lake, C.I. pigment yellow 12, C.I. pigment yellow 13, C.I. pigment yellow 14, C.I. pigment yellow 15, C.I. pigment yellow 17, C.I. pigment yellow 74, C.I. pigment yellow 93, C.I. pigment yellow 94, C.I. pigment yellow 138, C.I. pigment yellow 180, and C.I. pigment yellow 185.

Examples of orange colorant include red chrome yellow, molybdenum orange, permanent orange GTR, pyrazolone orange, vulcan orange, indanthrene brilliant orange RK, benzidine orange G, indanthrene brilliant orange GK, C.I. pigment orange 31, and C.I. pigment orange 43.

Examples of red colorant include red iron oxide, cadmium red, red lead, mercury sulfide, cadmium, permanent red 4R, lysol red, pyrazolone red, watching red, calcium salt, lake red C, lake red D, brilliant carmine 6B, eosin lake, rhodamine lake B, alizarin lake, brilliant carmine 3B, C.I. pigment red 2, C.I. pigment red 3, C.I. pigment red 5, C.I. pigment red 6, C.I. pigment red 7, C.I. pigment red 15, C.I. pigment red 16, C.I. pigment red 48:1, C.I. pigment red 53:1, C.I. pigment red 57:1, C.I. pigment red 122, pigment red 123, C.I. pigment red 139, C.I. pigment red 144, C.I. pigment red 149, C.I. pigment red 166, C.I. pigment red 177, C.I. pigment red 178, and C.I. pigment red 222.

Examples of purple colorant include manganese purple, fast violet B, and methyl violet lake.

Examples of blue colorant include Prussian blue, cobalt blue, alkali blue lake, Victoria blue lake, phthalocyanine blue, non-metal phthalocyanine blue, phthalocyanine blue-partial chlorination product, fast sky blue, indanthrene blue BC, C.I. pigment blue 15, C.I. pigment blue 15:2, C.I. pigment blue 15:3, C.I. pigment blue 16, and C.I. pigment blue 60.

Examples of green colorant include chromium green, chromium oxide, pigment green B, malachite green lake, final yellow green G, and C.I. pigment green 7.

Examples of white colorant include a compound such as zinc white, titanium oxide, antimony white, and zinc sulfide.

The colorants may be used each alone, or two or more of them with different colors may be used in combination. Further, two or more of them with the same color may be used in combination. A usage of the colorant is not limited to a particular amount, and preferably 5 parts by weight to 20 parts by weight, and more preferably 5 parts by weight to 10 parts by weight based on 100 parts by weight of the binder resin.

The colorant may be used as a masterbatch to be dispersed uniformly in the binder resin. Further, two or more of the colorants may be formed into a composite particle. The composite particles can be manufactured, for example, by adding an appropriate amount of water, lower alcohol and the like to two or more of colorants and granulating the mixture by a general granulating machine such as a high-speed mill, followed by drying. The masterbatch and the composite particles are mixed into the toner composition at the time of dry-mixing.

The toner base particle may contain a charge control agent in addition to the binder resin and the colorant. As the charge control agent, any types of charge control agent commonly used in this field for controlling positive charge and negative charge are usable.

Examples of the charge control agent for controlling positive charge include basic dye, quaternary ammonium salt, quaternary phosphonium salt, aminopyrine, pyrimidine compounds, polynuclear polyamino compounds, aminosilane, nigrosine dye and derivatives thereof, triphenylmethane derivatives, guanidine salt and amidin salt.

Examples of the charge control agent for controlling negative charge include oil-soluble dye such as oil black and spirone black, metal-containing azo compounds, azo complex dye, naphthene acid metal salt, metal complex and metal salt (the metal is chrome, zinc, zirconium or the like) of salicylic acid and derivatives thereof, boron compounds, fatty acid soap, long-chain alkylcarboxylic acid salt and resin acid soap. The charge control agents may be used each alone, or two or more of them may be used in combination according to need. A usage of the charge control agent is not limited to a particular amount and can be properly selected from a wide range, and preferably 0.5 parts by weight to 3 parts by weight based on 100 parts by weight of the binder resin.

Further, the toner base particle may contain a release agent in addition to the binder resin and the colorant. As the release agent, it is possible to use ingredients which are customarily used in the relevant field, including, for example, petroleum waxes such as paraffin wax and derivatives thereof, and microcrystalline wax and derivatives thereof; hydrocarbon-based synthetic waxes such as Fischer-Tropsch wax and derivatives thereof, polyolefin wax (e.g. polyethylene wax and polypropylene wax) and derivatives thereof, low-molecular-weight polypropylene wax and derivatives thereof, and polyolefinic polymer wax (low-molecular-weight polyethylene wax, etc.) and derivatives thereof; vegetable waxes such as carnauba wax and derivatives thereof, rice wax and derivatives thereof, candelilla wax and derivatives thereof, and haze wax; animal waxes such as bees wax and spermaceti wax; fat and oil-based synthetic waxes such as fatty acid amide and phenolic fatty acid ester; long-chain carboxylic acid and derivatives thereof; long-chain alcohol and derivatives thereof; silicone polymer; and higher fatty acid. Note that examples of the derivatives include oxides, block copolymers of vinylic monomer and wax, and graft-modified derivatives of vinylic monomer and wax. A usage of the wax may be appropriately selected from a wide range without particular limitation, and preferably 0.2 part by weight to 20 parts by weight, more preferably 0.5 part by weight to 10 parts by weight, particularly preferably 1.0 part by weight to 8.0 parts by weight based on 100 parts by weight of the binder resin.

The toner base particles obtained at the toner base particle producing step S1 preferably have a volume average particle size of 4 μm or more and 8 μm or less. In a case where the volume average particle size of the toner base particles falls within a range of 4 μm or more and 8 μm or less, it is possible to stably form a high-definition image for a long time. Moreover, by reducing the particle size within this range, a high image density is obtained even with a small attachment amount, which generates an effect of reducing an amount of toner consumption. In a case where the volume average particle size of the toner base particles is less than 4 μm, the particle size of the toner base particle becomes too small and thus high charging and low flowability are likely to occur. When the high charging and the low flowability of toner occur, it is not possible to stably supply the toner to a photoreceptor and thus a background fog and image density decrease are likely to occur. In a case where the volume average particle size of the toner base particles exceeds 8 μm, the particle size of the toner base particle becomes so large and thus the layer thickness of a formed image is so increased that an image with remarkable granularity is generated and the high-definition image is not obtainable. In addition, as the particle size of the toner base particle is increased, a specific surface area is reduced, resulting in decrease in a charge amount of the toner. When the charge amount of the toner is reduced, the toner is not stably supplied to the photoreceptor and pollution inside the apparatus due to toner scattering is likely to occur.

(2) Fine Resin Particle Preparing Step S2

At the fine resin particle preparing step S2, dried fine resin particles are prepared. Any methods may be used for the drying and it is possible to obtain the dried fine resin particles by a method such as drying with hot air receiving type, drying with heat transfer by heat conduction type, far infrared radiation drying, and microwave drying. The fine resin particles are used as a shell agent for forming a film on the toner base particle at the subsequent coating step S3. By forming the film on the surface of the toner base particle, for example, it is possible to prevent generation of toner aggregation during storage due to melting of low-melting point components such as a release agent contained in the toner base particles. Further, for example, in a case where a liquid in which the fine resin particles are dispersed is sprayed to coat the toner base particles, the shape of the fine resin particles remains on the surface of the toner base particle, and therefore, it is possible to obtain toner particles excellent in cleaning property compared to toner particles with smooth surfaces.

The fine resin particles can be obtained, for example, in a manner that resin which is a raw material of the fine resin particles is emulsified and dispersed into fine grains by using a homogenizer or the like machine. Further, the fine resin particles can also be obtained by polymerizing monomer components of the resin.

As the raw material of the fine resin particles, resin used for materials of a toner is usable and examples thereof include polyester, acrylic resin, styrene resin, and styrene-acrylic copolymer.

As the raw material of the fine resin particles is desirable a resin which is different from the binder resin contained in the toner base particles, and whose storage elastic modulus G' at a softening temperature of the toner base particles satisfies the following condition.

$$A<B; \text{ and } (B-A)<3\times10^3 Pa$$

where A and B indicate the following:

A: storage elastic modulus G' of the toner base particle at the softening temperature of the toner base particle, B: storage elastic modulus G' of the fine resin particle at the softening temperature of the toner base particle.

It is further desirable to satisfy $(B-A)<1\times10^3$ Pa.

In case of A=B; or A>B, lowering of a glass transition temperature Tg for a low-temperature fixing poses a problem that the preservation stability of the toner degrades, so that it is difficult to achieve both the preservation stability and the fixing property. In case of $(B-A)>3\times10^3$Pa, it is possible to achieve both the preservation stability and the fixing property, however, a problem is posed that even when the release agent melts during fixing, a resin layer becomes a wall, thereby exudation of the release agent is not so easy that high-temperature offset easily occurs.

Further, it is desirable that storage elastic moduli G' of both the toner base particle and the fine resin particle at a softening temperature of the toner base particle are $1.0\times10^2$Pa or more and less than $5.0\times10^4$ Pa. In case of less than $1.0\times10^2$Pa, the toner layer is easily disrupted during fixing and high-temperature offset phenomenon easily occurs despite the physicality of the fine resin particles. Further, in case of $5.0\times10^4$Pa or more, the toner layer is not so easily released from a fixing roller or a belt during fixing that a sheet as a whole may wind around the fixing roller or the belt.

Further, a softening temperature of the resin used as the raw material of the fine resin particles is preferably more than a glass transition temperature of the binder resin contained in the toner base particles, and more preferably 60° C. or higher.

This makes it possible to prevent the toner particles of the toner manufactured with the method of the invention from being fused each other during storage and to improve the storage stability. Further, the softening temperature of the resin used for the raw material of the fine resin particles depends on an image forming apparatus in which the toner is used, but is preferably 80° C. or higher and 140° C. or lower. By using the resin in such a temperature range, it is possible to obtain the toner having both the storage stability and the fixing property.

The volume average particle size of the fine resin particles needs to be sufficiently smaller than the average particle size of the toner base particles, and is preferably 0.05 μm or more and 1 μm or less. More preferably, the volume average particle size of the fine resin particles is 0.1 μm or more and 0.5 μm or less. In a case where the volume average particle size of the fine resin particles is 0.05 μm or more and 1 μm or less, a projection with a suitable size is formed on the surface of the toner base particle. Whereby, the toner manufactured with the method of the invention is easily caught by cleaning blades at the time of cleaning, resulting in improvement of the cleaning property.

It is preferable that an addition amount of the fine resin particles are 5 parts by weight or more based on 100 parts by weight of the toner base particles. In case of less than 5 parts by weight, it is so difficult to uniformly coat the toner base particle that depending on a type of the toner base particles the preservation stability may degrade.

(3) Coating Step S3

<Toner Manufacturing Apparatus>

Figure 2:
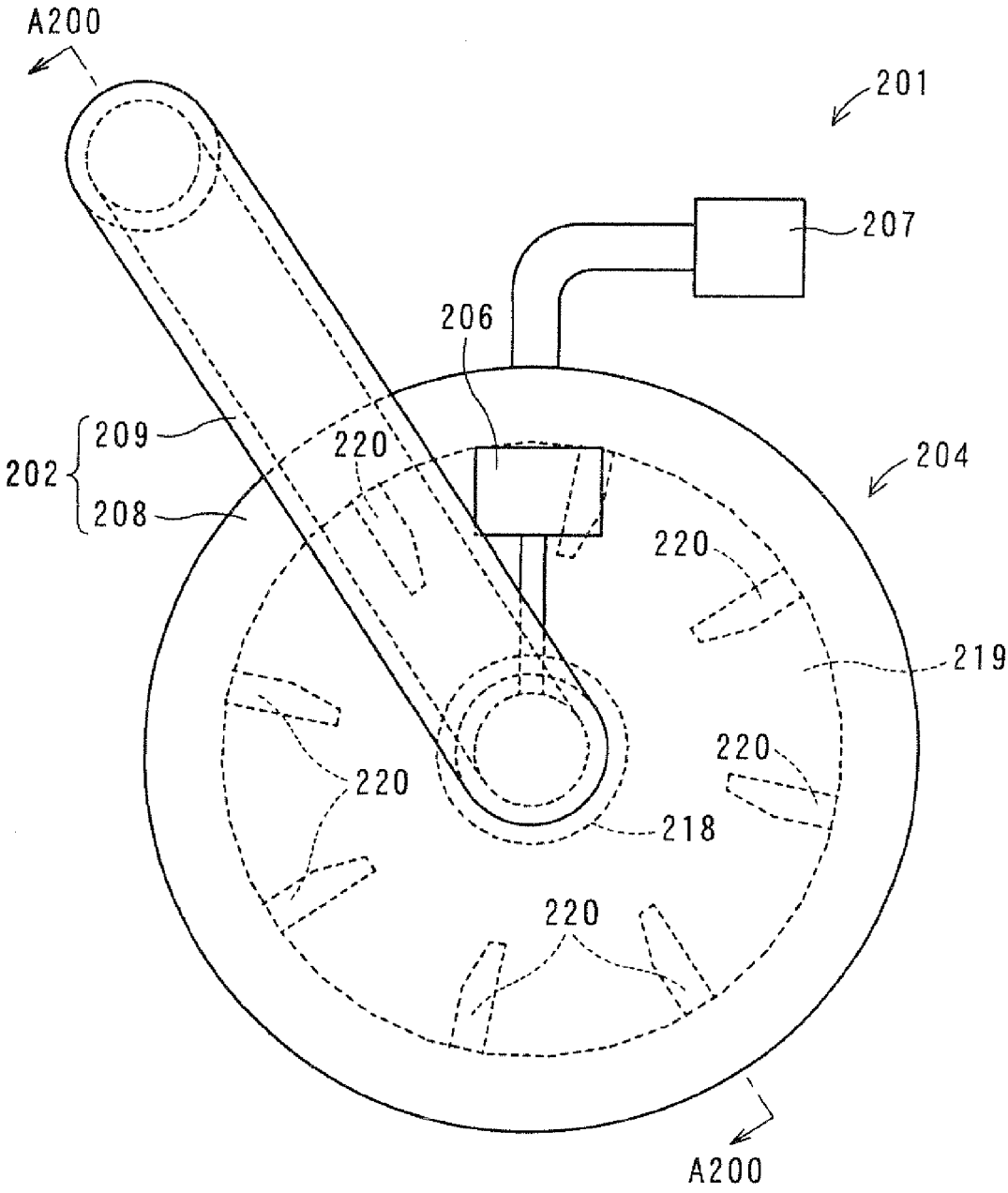
FIG. 2 is a front view of a configuration of a toner manufacturing apparatus used for the method for manufacturing a toner according to the invention.
Figure 3:
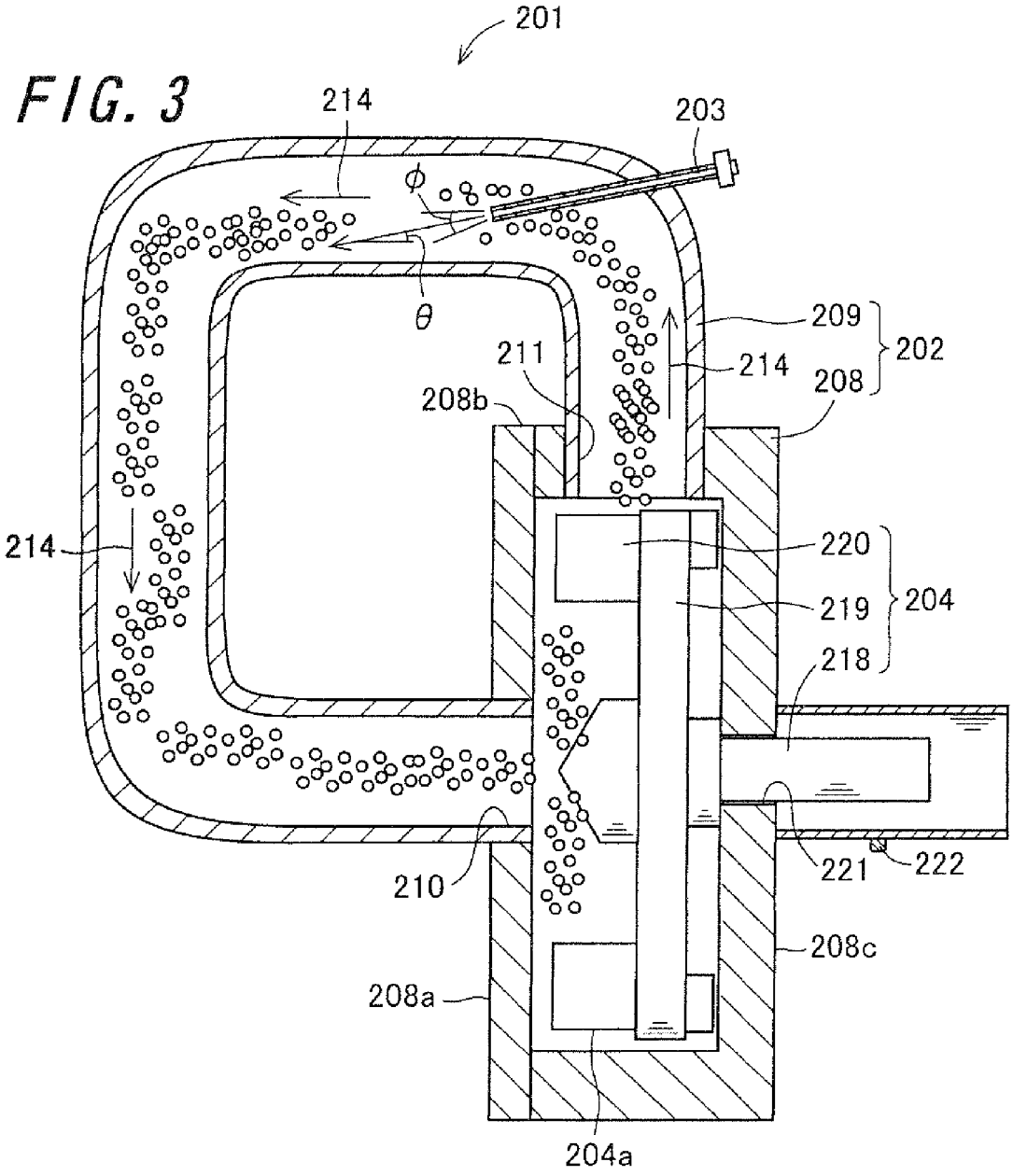
FIG. 3 is a schematic sectional view of the toner manufacturing apparatus shown in FIG. 2 taken along the cross-sectional line A200-A200.

FIG. 2 is a front view of a configuration of a toner manufacturing apparatus 201 used for the method for manufacturing a capsule toner of the invention. FIG. 3 a schematic sectional view of the toner manufacturing apparatus 200 shown in FIG. 2 taken along the cross-sectional line A200-A200. At the coating step S3, for example, by using the toner manufacturing apparatus 201 shown in FIG. 2, a fine particle mixture prepared at the fine resin particle preparing step S2 is adhered to the toner base particles produced at the toner base particle producing step S1 to form a resin film on the toner base particle by an impact force of a multiplier effect of circulation and stirring in the apparatus. The toner manufacturing apparatus 201, which is a rotary stirring apparatus, comprises a powder passage 202, a spraying section 203, a rotary stirring section 204, a temperature regulation jacket (not shown), a powder inputting section 206, and a powder collecting section 207. The rotary stirring section 204 and the powder passage 202 constitute a circulating section.

(Powder Passage)

The powder passage 202 comprises a stirring section 208 and a powder flowing section 209. The stirring section 208 is a cylindrical container-like member having an internal space. Opening sections 210 and 211 are formed in the stirring section 208 which is a rotary stirring chamber. The opening section 210 is formed at an approximate center part of a surface 208*a* in one side of an axial direction of the stirring section 208 so as to penetrate a side wall including the surface 208*a* of the stirring section 208 in a thickness direction thereof. Moreover, the opening section 211 is formed at a side surface 208*b* perpendicular to the surface 208*a* in one side of the axial direction of the stirring section 208 so as to penetrate a side wall including the side surface 208*b* of the stirring section 208 in a thickness direction thereof. The powder flowing section 209 which is a circulation tube has one end connected to the opening section 210 and another end connected to the opening section 211. Whereby, the internal space of the stirring section 208 and the internal space of the powder flowing section 209 are communicated to form the powder passage 202. The toner base particles, the fine resin particles and gas flow through the powder passage 202. The powder passage 202 is provided so that the powder flowing direction which is a direction in which the toner base particles and the fine resin particles flow is constant.

The temperature in the powder passage 202 is set to a glass transition temperature of the toner base particle or less, and is more preferably 30° C. or higher and not more than a glass transition temperature of the toner base particle. The temperature in the powder passage 202 is almost uniform at any parts by the flow of the toner base particles. In a case where the temperature in the powder passage 202 exceeds the glass transition temperature of the toner base particle, there is a possibility that the toner base particles are softened excessively and aggregation of the toner base particles is generated. Further, in a case where the temperature is lower than 30° C., the drying speed of the dispersion liquid is made slow and the productivity is lowered. Accordingly, in order to prevent aggregation of the toner base particles, it is necessary to maintain the temperatures of the powder passage 202 and the after-mentioned rotary stirring section 204 to the glass transition temperature of the toner base particle or less, Therefore, the after-mentioned temperature regulation jacket whose inner diameter is larger than the external diameter of the powder passage tube is disposed at least on a part of the outer side of the powder passage 202 and the rotary stirring section 204.

(Rotary Stirring Section)

The rotary stirring section 204 includes a rotary shaft member 218, a discotic rotary disc 219, and a plurality of stirring blades 220. The rotary shaft member 218 is a cylindrical-bar-shaped member that has an axis matching an axis of the stirring section 208, that is provided so as to be inserted in a through-hole 221 which penetrates the side wall including the surface 208*c* in the other side of the axial direction of the stirring section 208 in the thickness direction thereof, and that is rotated around the axis by a motor (not shown). The rotary disc 219 is a discotic member that has the axis supported by the rotary shaft member 218 so as to match the axis of the rotary shaft member 218 and that rotates with rotation of the rotary shaft member 218, The plurality of stirring blades 220 are supported by the peripheral edge of the rotary disc 219 and are rotated with rotation of the rotary disc 219.

At the coating step S3, the peripheral speed of the outermost periphery of the rotary stirring section 204 is preferably set to 30 m/sec or more, and more preferably to 50 m/sec or more. The outermost periphery of the rotary stirring section 204 is a part 204*a* of the rotary stirring section 204 that has the longest distance from the axis of the rotary shaft member 218 in the direction perpendicular to the extending direction of the rotary shaft member 218 of the rotary stirring section 204. In a case where the peripheral speed in the outermost periphery of the rotary stirring section 204 is set to 30 m/sec or more at the time of rotation, it is possible to isolate and fluidize the toner base particles. In a case where the peripheral speed in the outermost periphery is less than 30 m/sec, it is impossible to isolate and fluidize the toner base particles and the fine resin particles, thus making it impossible to uniformly coat the toner base particles with the resin film.

The toner base particles and the fine resin particles preferably collide with the rotary disc 219 vertically. Whereby, it is possible to stir the toner base particles and the fine resin particles sufficiently, to coat the toner base particles with the fine resin particles more uniformly and to further improve yield of the toner in which the coating layer is uniform.

(Spraying Section)

The spraying section 203 is provided so as to be inserted in an opening formed on an outer wall of the powder passage 202, and in the powder flowing section 209, the spraying section 203 is provided in the powder flowing section that is on the side closest to the opening section 211 in the flowing direction of the toner base particles and the fine resin particles. The spraying section 203 includes a liquid reservoir that reserves liquid, a carrier gas supplying section that supplies carrier gas, and a two-fluid nozzle that mixes the liquid and the carrier gas, and ejects the resultant mixture to the toner base particles present in the powder passage 202 so as to spray droplets of the liquid to the toner base particles. As the carrier gas, compressed air or the like is usable. The liquid, namely a substance in the form of liquid, fed to the spraying section 203 by a liquid feeding pump with a constant volume of flow and then sprayed by the spraying section 203 is gasified so that the gasified substance is spread on the surfaces of the toner base particles and the fine resin particles. Whereby, the toner base particles and the fine resin particles are plasticized.

(Temperature Regulation Jacket)

The temperature regulation jacket (not shown), which is a temperature regulation section, is provided at least on a part of the outside of the powder passage 202 and adjusts temperatures in the powder passage 202 and of the rotary stirring section 204 to a predetermined temperature by passing a cooling medium or a heating medium through the internal space of the jacket. This makes it possible at a temperature regulation step S3*a* mentioned below to control the temperature in the powder passage and outside of the rotary stirring section to a temperature or less at which the toner base particles and the fine resin particles are not softened and deformed. Moreover, at a spraying step S3*c* and a film-forming step S3*d*, a variation in the temperatures applied to the toner base particles, the fine resin particles and the liquid can be reduced, and thus the stable fluidizing state of the toner base particles and the fine resin particles can be kept.

In the embodiment, the temperature regulation jacket is preferably provided over the entire outside of the powder passage 202. The toner base particles and the fine resin particles generally collide with the inner wall of the powder passage many times, and a part of the collision energy is converted into the thermal energy at the time of collision and is accumulated in the toner base particles and the fine resin particles. As the number of the collision increases, the thermal energy accumulated in the particles increases and then the toner base particles and the fine resin particles are softened to adhere to the inner wall of the powder passage. By providing the temperature regulation jacket over the entire outside of the powder passage 202, an adhesive force of the toner base particles and the fine resin particles to the inner wall of the powder passage is lowered so that it is possible to reliably prevent adhesion of the toner base particles to the inner wall of the powder passage 202 due to a rapid temperature rise in the apparatus and thus to avoid the narrowing inside the powder passage due to the toner base particles and the fine resin particles. Accordingly, the toner base particles are coated with the fine resin particles uniformly, resulting that it is possible to manufacture a toner excellent in cleaning property in higher yield.

Further, in the inside of the powder flowing section 209 downstream of the spraying section 203, the sprayed liquid remains undried, and thus, if the temperature is improper, the drying speed is made slow and the liquid is easily retained. When the toner base particles are in contact therewith, the toner base particles are easily adhered to the inner wall of the powder passage 202, which becomes an aggregation generation source of the toner. In the inner wall near the opening section 210, the toner base particles that flow into the stirring section 208 collide with the toner base particles that flow in the stirring section 208 with stirring of the rotary stirring section 204, thereby the collided toner base particles are easily adhered to the vicinity of the opening section 210. Accordingly, by providing the temperature regulation jacket in such a part to which the toner base particles are easily adhered, it is possible to prevent the toner base particles from being adhered to the inner wall of the powder passage 202 more reliably.

(Powder Inputting Section and Powder Collecting Section)

Figure 4:
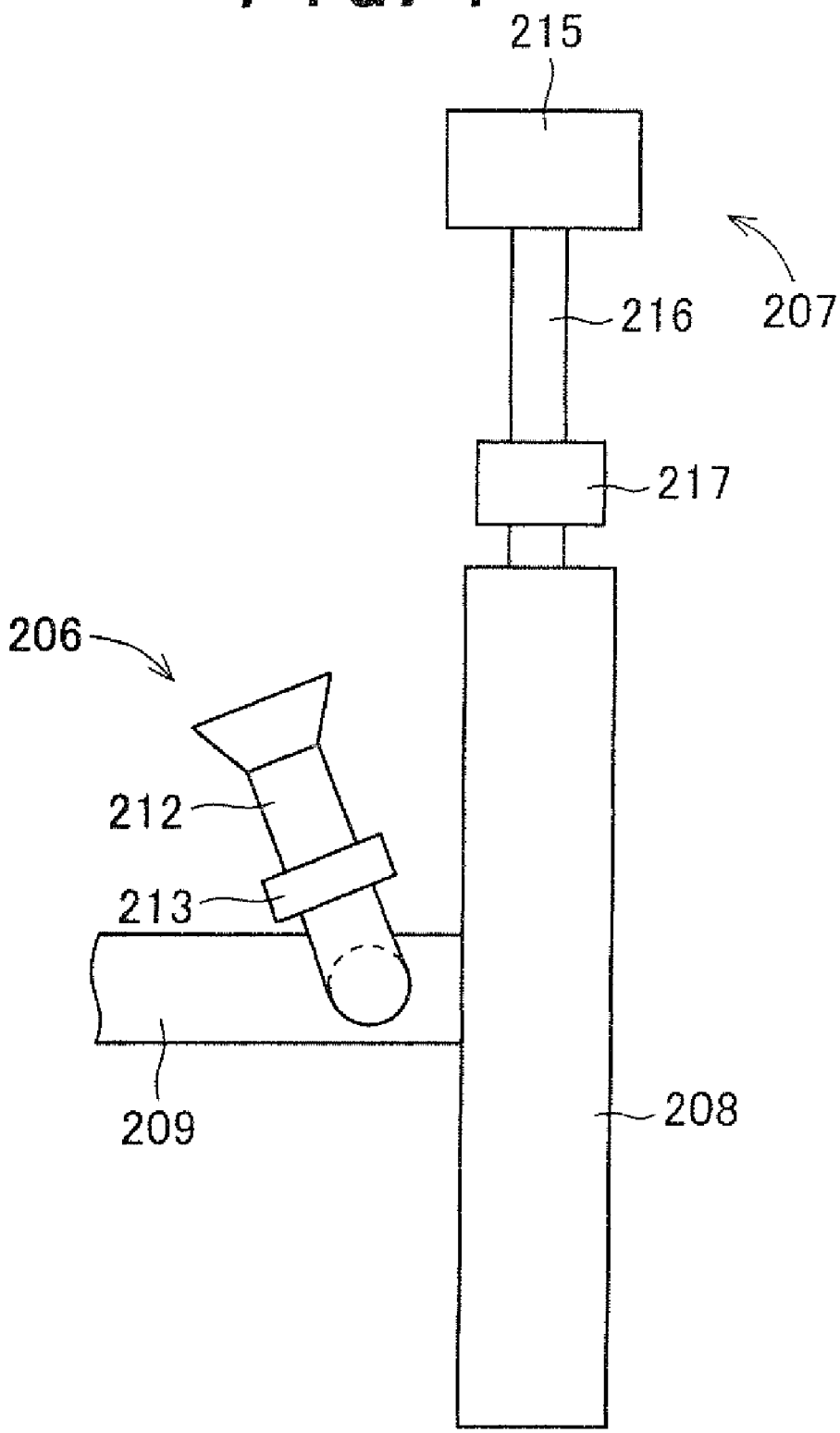
FIG. 4 is a front view of a configuration around the powder inputting section and the powder collecting section.

The powder inputting section 206 and the powder collecting section 207 are connected to the powder flowing section 209 of the powder passage 202, FIG. 4 is a front view of a configuration around the powder inputting section 206 and the powder collecting section 207.

The powder inputting section 206 includes a hopper not shown) that supplies the toner base particles and the fine resin particles, a supplying tube 212 that communicates the hopper and the powder passage 202, and an electromagnetic valve 213 provided in the supplying tube 212. The toner base particles and the fine resin particles supplied from the hopper are supplied to the powder passage 202 through the supplying tube 212 in a state where the passage in the supplying tube 212 is opened by the electromagnetic valve 213. The toner base particles and the fine resin particles supplied to the powder passage 202 flow in the constant powder flowing direction with stirring by the rotary stirring section 204. Moreover, the toner base particles and the fine resin particles are not supplied to the powder passage 202 in a state where the passage in the supplying tube 212 is closed by the electromagnetic valve 213.

The powder collecting section 207 includes a collecting tank 215, a collecting tube 216 that communicates the collecting tank 215 and the powder passage 202, and an electromagnetic valve 217 provided in the collecting tube 216. The toner particles flowing through the powder passage 202 are collected in the collecting tank 215 through the collecting tube 216 in a state where the passage in the collecting tube 216 is opened by the electromagnetic valve 217, Moreover, the toner particles flowing through the powder passage 202 are not collected in a state where the passage in the collecting tube 216 is closed by the electromagnetic valve 217.

The coating step S3 using the afore-mentioned toner manufacturing apparatus 200 includes a temperature regulation step S3*a*, a fine resin particle adhering step S3*b*, a spraying step S3*c*, a film-forming step S3*d*, and a collecting step S3*e*.

(3)-1 Temperature Regulation Step S3*a*

At the temperature regulation step S3*a*, while the rotary stirring section 204 is rotated, temperatures in the powder passage 202 and of the rotary stirring section 204 are adjusted to a predetermined temperature by passing a medium through the temperature regulation jacket disposed on the outside thereof. This makes it possible to control the temperature in the powder passage 202 at a temperature or less at which the toner base particles and the fine resin particles that are inputted at the after-mentioned fine resin particle adhering step S3*b* are not softened and deformed.

(3)-2 Fine Resin Particle Adhering Step S3*b*

At the fine resin particle adhering step S3*b*, the toner base particles and the fine resin particles, and the afore-mentioned fine particle mixture containing fine wax particles are supplied from the powder inputting section 206 to the powder passage 202 in a state where the rotary shaft member 218 of the rotary stirring section 204 is rotated.

The toner base particles and the fine resin particles supplied to the powder passage 202 are stirred by the rotary stirring section 204 to flow through the powder flowing section 209 of the powder passage 202 in the direction indicated by the arrow 214, Whereby, the fine resin particles are adhered to the surface of the toner base particle.

(3)-3 Spraying Step S3*c*

At the spraying step S3*c*, to the toner base particles and fine resin particles in a fluidized state, a liquid having an effect of not dissolving but plasticizing the particles is sprayed from the aforementioned spraying section 203 by carrier gas.

It is preferable that the sprayed liquid, namely the substance in the form of liquid, is gasified to have a constant gas concentration in the powder passage 202 and the gasified substance is exhausted outside the powder passage through the through-hole 221. Whereby, the concentration of the gasified substance in the powder passage 202 is kept constant and it is possible to make the drying speed of the liquid higher than a case where the concentration of the gasified liquid is not kept constant. Accordingly, it is possible to prevent that the toner particles on which undried liquid is remained are adhered to other toner particles and to further suppress aggregation of the toner particles. As a result, it is possible to further improve yield of the toner in which the coating layer is uniform.

The concentration of the gasified substance measured by a concentration sensor in a gas exhausting section 222 is preferably around 3% or less. In a case where the concentration is around 3% or less, the drying speed of the liquid can be increased sufficiently, thus making it possible to prevent adhesion of the undried toner base particles on which the liquid remains to other toner base particles and to prevent aggregation of the toner base particles. Moreover, the concentration of the gasified substance is more preferably 0.1% or more and 3.0% or less. In a case where the concentration falls within this range, it is possible to prevent aggregation of the toner base particles without lowering the productivity.

In the embodiment, it is preferable that the liquid is started to be sprayed after the flow rate of the toner base particles and the fine resin particles is stabilized in the powder passage 202. Whereby, it is possible to spray the liquid to the toner base particles and the fine resin particles uniformly, thus making it possible to improve yield of the toner in which the coating layer is uniform.

The liquid having an effect of not dissolving but plasticizing the toner base particles and the fine resin particles is not particularly limited, and is preferably a liquid that is easily vaporized since the liquid needs to be removed from the toner base particles and the fine resin particles after the liquid is sprayed. An example of the liquid includes a liquid including lower alcohol. Examples of the lower alcohol include methanol, ethanol, and propanol. In a case where the liquid includes such lower alcohol, it is possible to enhance the wettability of the fine resin particles as a coating material with respect to the toner base particles, and adhesion of the fine resin particles over the entire surfaces or large parts of the toner base particles, deformation and film-forming are easily performed. Further, since the lower alcohol has a high vapor pressure, it is possible to further shorten the drying time at the time of removing the liquid and to suppress aggregation of the toner base particles.

Further, the viscosity of the liquid sprayed is preferably 5 cP or less. The viscosity of the liquid is measured at 25° C., and can be measured, for example, by a cone/plate type rotation viscometer. A preferable example of the liquid having the viscosity of 5 cP or less includes alcohol. Examples of the alcohol include methyl alcohol and ethyl alcohol. These types of alcohol have low viscosity and are easily vaporized, and therefore, when the liquid includes the alcohol, it is possible to spray the liquid with a minute droplet diameter without coarsening a diameter of the spray droplet of the liquid to be sprayed from the spraying section 203. It is also possible to spray the liquid with a uniform droplet diameter. It is possible to further promote fining of the droplet at the time of collision of the toner base particles and the droplets. This makes it possible to obtain the coated toner having excellent uniformity by uniformly wetting the surfaces of the toner base particle and the fine resin particle with the liquid, fitting the liquid to the surfaces of the toner base particle and the fine resin particle and softening the fine resin particles by a multiplier effect with collision energy.

An angle θ formed by the liquid spraying direction which is a direction of the axis of the two-fluid nozzle of the spraying section 203 and the powder flowing direction which is a direction in which the toner base particles and the fine resin particles flow in the powder passage 202 is preferably 0° or more and 45° or less. In a case where the angle θ falls within this range, the droplets of the liquid are prevented from recoiling from the inner wall of the powder passage 202, and yield of the toner base particle coated with the resin film can be further improved. In a case where the angle θ exceeds 45°, the droplets of the liquid easily recoil from the inner wall of the powder passage 202 and the liquid is easily retained, thus generating aggregation of the toner particles and deteriorating the yield.

Further, a spreading angle ϕ of the liquid sprayed by the spraying section 203 is preferably 20° or more and 90° or less. In a case where the spreading angle ϕ falls out of this range, it is likely to be difficult to spray the liquid uniformly to the toner base particles.

(3)-4 Film-Forming Step S3*d*

At the film-forming step S3*d*, stirring by the rotary stirring section 204 is continued at a predetermined temperature to flow the toner base particles and the fine resin particles until the fine resin particles adhered to the toner base particle are softened to form a film, thereby the toner base particle is coated with the resin layer.

(3)-5 Collecting Step S3*e*

At the collecting step S3*e*, spraying of the liquid from the spraying section and rotation of the rotary stirring section 204 are stopped, and the capsule toner is ejected outside the apparatus from the powder collecting section 207 and is collected.

The configuration of such a toner manufacturing apparatus 200 is not limited to the above and various alterations may be added thereto. For example, the temperature regulation jacket may be provided over the entire outside of the powder flowing section 209 and the stirring section 208, or may be provided in a part of the outside of the powder flowing section 209 or the stirring section 208. In a case where the temperature regulation jacket is provided over the entire outside of the powder flowing section 209 and the stirring section 208, it is possible to prevent the toner base particles from being adhered to the inner wall of the powder passage 202 more reliably.

Further, the toner manufacturing apparatus can be also structured by combining a commercially available stirring apparatus and the spraying section. An example of the commercially available stirring apparatus provided with the powder passage and the rotary stirring section includes HYBRIDIZATION SYSTEM (trade name, manufactured by Nara Machinery Co., Ltd). By installing a liquid spraying unit in such a stirring apparatus, this stirring apparatus is usable as the toner manufacturing apparatus used for the method for manufacturing a toner of the invention.

2. Toner

A toner according to an embodiment of the invention is manufactured by the method for manufacturing a toner according to the above embodiment. Since the coated amount of the fine resin particles in the toner obtained by the method for manufacturing a toner according to an embodiment is so uniform that the toner property such as chargeability is made uniform between individual toner. particles. Accordingly, in a case where an image is formed with the use of such a toner, it is possible to obtain an image having high definition and excellent image quality without unevenness in density.

To the toner of the invention, an external additive may be added. As the external additive, heretofore known substances can be used including silica, titanium oxide and the like. Further, it is preferred that these substances are surface-treated with silicone resin, a silane coupling agent and the like. A preferable usage of the external additive is 1 part by weight to 10 parts by weight based on 100 parts by weight of the toner.

3. Developer

A developer according to an embodiment of the invention includes the toner according to the above embodiment. Since the developer can have uniform toner properties, the developer capable of maintaining excellent development performance is obtained. The developer of the embodiment can be used in the form of either one-component developer or two-component developer. In a case where the developer is used in the form of one-component developer, only the toner is used without using a carrier. Further, a blade and a fur brush are used to effect fictional electrification at a developing sleeve so that the toner is attached onto the sleeve, thereby conveying the toner to perform image formation. In a case where the developer is used in the form of two-component developer, the toner of the above embodiment is used together with a carrier.

As the carrier, heretofore known substances can be used including, for example, single or complex ferrite composed of iron, copper, zinc, nickel, cobalt, manganese, chromium and the like; a resin-coated carrier having carrier core particles whose surfaces are coated with coating substances; or a resin-dispersion carrier in which magnetic particles are dispersed in resin.

As the coating substance, heretofore known substances can be used including, for example, polytetrafluoroethylene, monochloro-trifluoroethylene polymer, polyvinylidene-fluoride, silicone resin, polyester resin, metal compound of di-tertiary-butylsalicylic acid, styrene resin, acrylic resin, polyamide, polyvinyl butyral, nigrosine, aminoacrylate resin, basic dye or lake thereof, fine silica powder, and fine alumina powder. In addition, the resin used for the resin-dispersion carrier is not limited to a particular resin, and examples thereof include styrene-acrylic resin, polyester resin, fluorine resin, and phenol resin. Both of the coating substance and the resin are preferably selected according to the toner components. Those substances and resins listed above may be used each alone, and two or more of them may be used in combination.

A particle of the carrier preferably has a spherical shape or flattened shape. A particle size of the carrier is not limited to a particular diameter, and in consideration of forming higher-quality images, the particle size of the carrier is preferably 10 μm to 100 μm and more preferably 20 μm to 50 μm. Further, the resistivity of the carrier is preferably $10^8 \Omega \cdot cm$ or more, and more preferably $10^{12} \Omega \cdot cm$ or more.

The volume resistivity of the carrier is measured as follows. At the outset, the carrier particles are put in a container having a cross section of 0.50 $cm^2$, thereafter tapped. Subsequently, a load of 1 $kg/cm^2$ is applied to the carrier particles which are held in the container as just stated. When an electric field of 1,000 V/cm is generated between the weight and a bottom electrode of the container by application of voltage, a current value is obtained. Based on the current value the resistivity of the carrier is determined. When the resistivity is low, the carrier will be charged upon application of bias voltage to the developing sleeve, which causes the carrier particles to be more easily attached to the photoreceptor. Further, breakdown of bias voltage is more liable to occur.

Magnetization intensity (maximum magnetization) of the carrier is preferably 10 emu/g to 60 emu/g and more preferably 15 emu/g to 40 emu/g. Under the condition of magnetic flux density of an ordinary developing roller, no magnetic binding force works on the carrier having magnetization intensity less than 10 emu/g, which may cause the carrier to scatter. The carrier having magnetization intensity more than 60 emu/g has bushes which are too large to keep the non-contact state of the toner with an image bearing member in a non-contact development. Further, sweeping streaks may be easily appeared on a toner image in a contact development.

A use ratio of the toner to the carrier in the two-component developer is not limited to a particular ratio, and the use ratio is appropriately selected according to the types of the toner and the carrier. For example, in a case where the toner is mixed with the resin-coated carrier (having density of 5 $g/cm^2$ to 8 $g/cm^2$), the toner may be contained such that a content of the toner in the developer is 2% by weight to 30% by weight and preferably 2% by weight to 20% by weight of the total amount of the developer. Further, coverage of the carrier with the toner is preferably 40% to 80%.

4. Image Forming Apparatus

Figure 5:
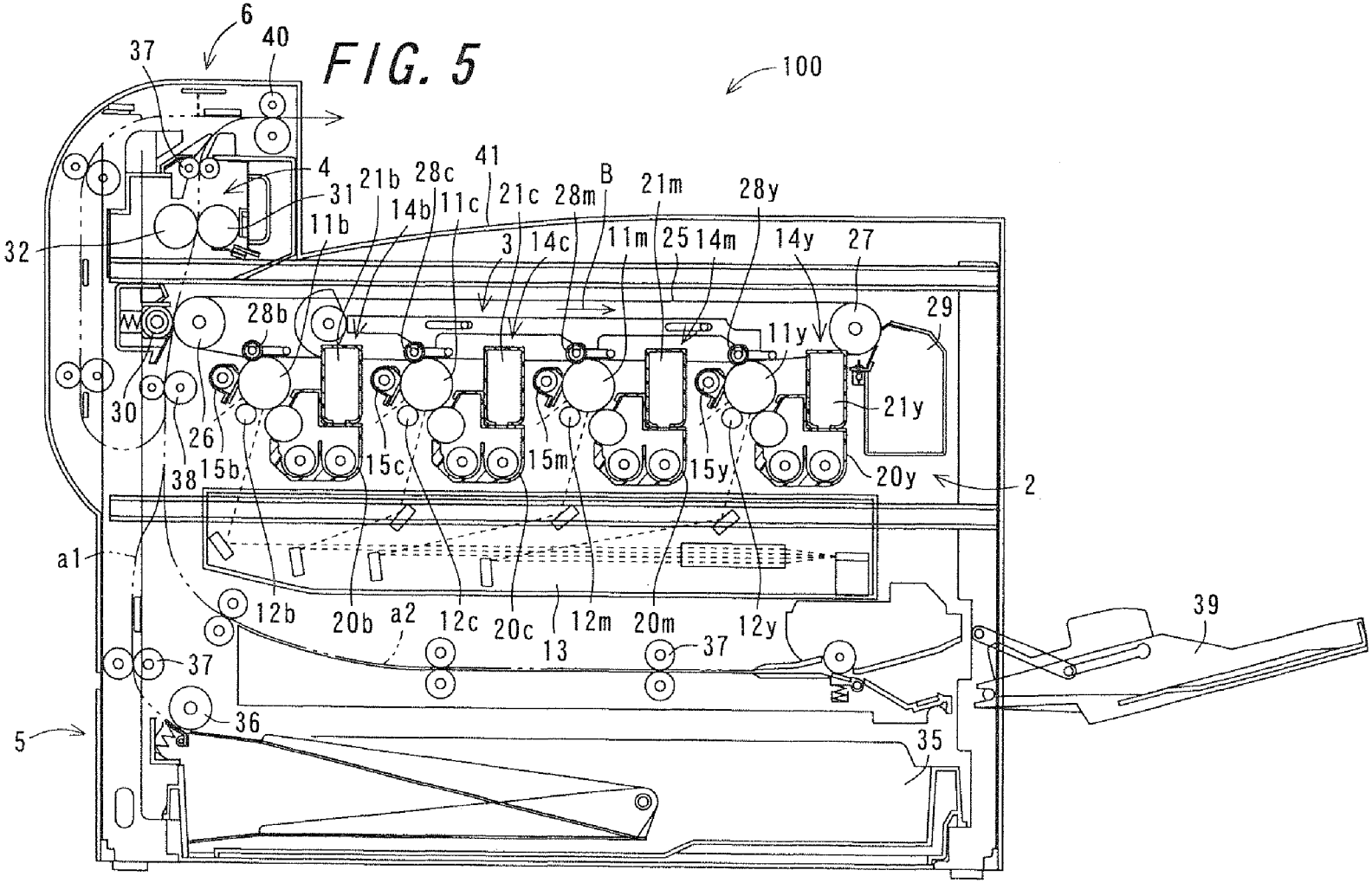
FIG. 5 is a view showing a configuration of an image forming apparatus of the embodiment.

FIG. 5 shows a configuration of an image forming apparatus 100 according to an embodiment of the invention. The image forming apparatus 100 is a multifunctional peripheral which combines a copier function, a printer function, and a facsimile function. In the image forming apparatus 100, according to image information transmitted thereto, a full-color or monochrome image is formed on a recording medium. To be specific, three print modes, i.e., a copier mode, a printer mode, and a facsimile mode are available in the image forming apparatus 100, one of which print modes is selected by a control unit (not shown) in response to an operation input given by an operating section (not shown), or reception of a print job given by a personal computer, a personal digital assistant, an information record storage medium, or an external equipment having a memory device, and the like.

The image forming apparatus 100 includes a photoreceptor drum 11 which is an image bearing member, an image forming section 2, a transfer section 3, a fixing section 4, a recording medium feeding section 5, and a discharging section 6. In accordance with image information of respective colors of black (b), cyan (c), magenta (m), and yellow (y) which are contained in color image information, there are provided respectively four sets of the components constituting the toner image forming section 2 and some parts of the components contained in the transfer section 3. Herein, the four sets of respective components provided for the respective colors are distinguished by giving alphabets indicating the respective colors to the end of the reference numerals, and in a case where the sets are collectively referred to, only the reference numeral is shown.

The photoreceptor drum 11 is a roller-like member provided so as to be capable of being rotationally driven around an axis by a rotary driving section (not shown) and on the surface thereof an electrostatic latent image is formed. The rotary driving section of the photoreceptor drum 11 is controlled by a control unit that is realized by a central processing unit (CPU). The photoreceptor drum 11 comprises a conductive substrate (not shown), and a photosensitive layer (not shown) formed on the surface of the conductive substrate.

The conductive substrate may be in various shapes including a cylindrical shape, a columnar shape, or a thin film sheet shape, for example. Among them, the cylindrical shape is preferable. The conductive substrate is formed of a conductive material.

As the conductive material, those customarily used in the relevant field can be used including, for example, a metal such as aluminum, copper, brass, zinc, nickel, stainless steel, chromium, molybdenum, vanadium, indium, titanium, geld, and platinum; alloy formed of two or more of the metals; a conductive film in which a conductive layer containing one or two or more of aluminum, aluminum alloy, tin oxide, gold, indium oxide, etc. is formed on a film-like substrate such as a synthetic resin film, a metal film, and a paper sheet; and a resin composition containing conductive particles and/or conductive polymer. As the film-like substrate used for the conductive film, a synthetic resin film is preferred and a polyester film is particularly preferred. Further, as the method of forming the conductive layer in the conductive film, vapor deposition, coating, etc. are preferred.

The photosensitive layer is formed, for example, by stacking a charge generating layer and a charge transporting layer on the surface of the conductive substrate. In this case, an undercoat layer is preferably formed between the conductive substrate and the charge generating layer or the charge transporting layer. The undercoat layer covers the flaws and irregularities present on the surface of the conductive substrate, leading to a smooth surface of the photosensitive layer. Whereby, chargeability of the photosensitive layer can be prevented from degrading during repetitive use, and the chargeability of the photosensitive layer under either a low temperature circumstance or a low humidity circumstance can be enhanced. Further, the photosensitive layer may have a highly-durable three-layer structure having a photoreceptor surface-protecting layer provided as the top layer.

The charge generating layer contains as a main substance a charge generating substance that generates charges under irradiation of light, and contains known binder resin, a plasticizer, a sensitizer, etc. As the charge generating substance, materials used customarily in the relevant field can be used including, for example, perylene pigments such as perylene imide and perylenic acid anhydride; polycyclic quinone pigments such as quinacridone and anthraquinone; phthalocyanine pigments such as metal and non-metal phthalocyanine, and halogenated non-metal phthalocyanine; squalium dye; azulenium dye; thiapylirium dye; and azo pigments having carbazole skeleton, styrylstilbene skeleton, triphenylamine skeleton, dibenzothiophene skeleton, oxadiazole skeleton, fluorenone skeleton, bisstilbene skeleton, distyryloxadiazole skeleton, distyryl carbazole skeleton or the like. Among these charge generating substances, phthalocyanine pigment and azo pigment are preferred. Among the types of phthalocyanine pigment, non-metal phthalocyanine pigment and oxotitanyl phthalocyanine pigment are preferred, and among types of azo pigment, bisazo pigment containing a fluorene ring and/or a fluorenone ring, bisazo pigment containing aromatic amine, trisazo pigment and the like are preferred. These preferred charge generating substances have high charge generating ability and are suitable for obtaining a highly-sensitive photosensitive layer. The charge generating substances may be used each alone, or two or more of them may be used in combination.

The content of the charge generating substance is not particularly limited, and preferably from 5 parts by weight to 500 parts by weight and more preferably from 10 parts by weight to 200 parts by weight based on 100 parts by weight of the binder resin in the charge generating layer. As the binder resin for the charge generating layer, materials used customarily in the relevant field can be used including, for example, melamine resin, epoxy resin, silicone resin, polyurethane, acrylic resin, vinyl chloride-vinyl acetate copolymer resin, polycarbonate, phenoxy resin, polyvinyl butyral, polyarylate, polyamide, and polyester. The binder resins may be used each alone or two or more of them may be used in combination.

The charge generating layer can be formed by preparing a coating solution for charge generating layer including the afore-mentioned components (the charge generating substance, the binder resin and, optionally, the plasticizer, the sensitizer, etc.) and by applying the coating solution to the surface of the conductive substrate, followed by drying. When preparing the coating solution for charge generating layer, the respective components are dissolved or dispersed in an appropriate organic solvent. The film thickness of the charge generating layer formed in this way is not particularly limited, and preferably from 0.05 μm to 5 μm and more preferably from 0.1 μm to 2.5 μm.

The charge transporting layer stacked over the charge generating layer contains as a main substance a charge transporting substance and binder resin, and optionally contains a known antioxidant, plasticizer, sensitizer, lubricant, etc. The charge transporting substance has an ability of receiving and transporting charges generated from the charge generating substance, and materials used customarily in the relevant field can be used for the charge transporting substance. The example of the materials includes: electron donating materials such as poly-N-vinylcarbazole and derivatives thereof, poly-γ-carbazolyl ethyl glutamate and derivatives thereof, pyrene-formaldehyde condensation and derivatives thereof, polyvinylpyrene, polyvinylphenanthrene, oxazole derivatives, oxadiazole derivatives, imidazole derivatives, 9-(p-diethylaminostyryl)anthracene, 1,1-bis(4-dibenzylaminophenyl)propane, styrylanthracene, styrylpyrazoline, pyrazoline derivatives, phenylhydrazone, hydrazone derivatives, triphenylamine compounds, tetraphenyldiamine compounds, triphenylmethane compounds, stilbene compounds, and azine compounds having 3-methyl-2-benzothazoline rings; and electron accepting materials such as fluorenone derivatives, dibenzothiophene derivatives, indenothiophene derivatives, phenanthrenequinone derivatives, indenopyridine derivatives, thioxanthone derivatives, benzo[c]cinnoline derivatives, phenazine oxide derivatives, tetracyanoethylene, tetracyanoquinodimethane, bromanil, chloranil, and benzoquinone.

The charge transporting substances may be used each alone, or two or more of them may be used in combination. The content of the charge transporting substance is not particularly limited, and preferably from 10 parts by weight to 300 parts by weight and more preferably from 30 parts by weight to 150 parts by weight based on 100 parts by weight of the binder resin in the charge transporting layer.

As the binder resin for charge transporting layer, it is possible to use materials which are used customarily in the relevant field and capable of uniformly dispersing the charge transporting substance, including, for example, polycarbonate, polyarylate, polyvinylbutyral, polyamide, polyester, polyketone, epoxy resin, polyurethane, polyvinylketone, polystyrene, polyacrylamide, phenolic resin, phenoxy resin, polysulfone resin, and copolymer resin thereof. Among these materials, in view of the film forming property, and the wear resistance, the electrical property etc. of the obtained charge transporting layer, it is preferable to use polycarbonate which contains bisphenol Z as a monomer component (hereinafter referred to as "bisphenol Z polycarbonate"), and a mixture of bisphenol Z polycarbonate and other polycarbonate. The binder resins may be used each alone, or two or more of them may be used in combination.

The charge transporting layer preferably contains an antioxidant together with the charge transporting substance and the binder resin for charge transporting layer. As the antioxidant, substances used customarily in the relevant field can be used including, for example, vitamin E, hydroquinone, hindered amine, hindered phenol, paraphenylene diamine, arylalkane and derivatives thereof, organic sulfur compounds, and organic phosphorus compounds. The antioxidants may be used each alone, or two or more of them may be used in combination. The content of the antioxidant is not particularly limited, and is from 0.01% by weight to 10% by weight and preferably from 0.05% by weight to 5% by weight of the total amount of the components constituting the charge transporting layer.

The charge transporting layer can be formed by preparing a coating solution for charge transporting layer including the afore-mentioned components (the charge transporting substance, the binder resin and, optionally, the antioxidant, the plasticizer, the sensitizer, etc.) and by applying the coating solution to the surface of the charge generating layer, followed by drying. When preparing the coating solution for charge transporting layer, the respective components are dissolved or dispersed in an appropriate organic solvent. The thickness of the charge transporting layer formed in this way is not particularly limited, and preferably from 10 μm to 50 μm and more preferably from 15 μm to 40 μm.

Further, it is also possible to form a photosensitive layer in which the charge generating substance and the charge transporting substance are present in one layer. In this case, the kind and content of the charge generating substance and the charge transporting substance, the kind of the binder resin, and other additive may be the same as those in a case of forming separately the charge generating layer and the charge transporting layer.

In the embodiment, there is used a photoreceptor drum which has an organic photosensitive layer as described above containing the charge generating substance and the charge transporting substance. It is, however, also possible to use, instead of the above photoreceptor drum, a photoreceptor drum which has an inorganic photosensitive layer containing silicon or the like as a component.

The image forming section 2 includes a charging device 12, an exposure unit 13, a developing section 14, and a cleaning unit 15. The charging device 12 and the exposure unit 13 function as a latent image forming section. The charging device 12, the developing section 14, and the cleaning unit 15 are disposed in the order just stated around the photoreceptor drum 11. The charging device 12 is disposed below the developing section 14 in the vertical direction and the cleaning unit 15.

In the image forming section 2, light corresponding to the image information is emitted from the exposure unit 13 to the surface of the photoreceptor drum 11 which has been evenly charged by the charging device 12, thereby forming an electrostatic latent image. The toner is then supplied from the developing section 14 to the electrostatic latent image, thereby forming a toner image. After the toner image is transferred to an intermediate transfer belt 25, the toner which remains on the surface of the photoreceptor drum 11 is removed by the cleaning unit 15. A series of toner image forming operations just described are repeatedly carried out.

The charging device 12 is a device that charges the surface of the photoreceptor drum 11 so as to have predetermined polarity and potential. As the charging device 12, it is possible to use a charging brush type charging device, a charger type charging device, a pin array type charging device, an ion-generating device, etc. Although the charging device 12 faces the photoreceptor drum 11 and is disposed away from the surface of the photoreceptor drum 11 longitudinally along the photoreceptor drum 11 in the embodiment, the configuration is not limited thereto. For example, a charging roller may be used as the charging section 12, and the charging roller may be disposed in pressure-contact with the photoreceptor drum. It is also possible to use a contact-charging type charging device such as a charging brush or a magnetic brush.

The exposure unit 13 is disposed so that light corresponding to the image information of each color emitted therefrom passes between the charging device 12 and the developing section 14 and reaches the surface of the photoreceptor drum 11. As the exposure unit 13, it is possible to use a laser scanning unit having a laser-emitting section and a plurality of reflecting mirrors, for example. The other usable examples of the exposure unit 13 may include an LED array or a unit in which a liquid-crystal shutter and a light source are appropriately combined with each other.

Figure 6:
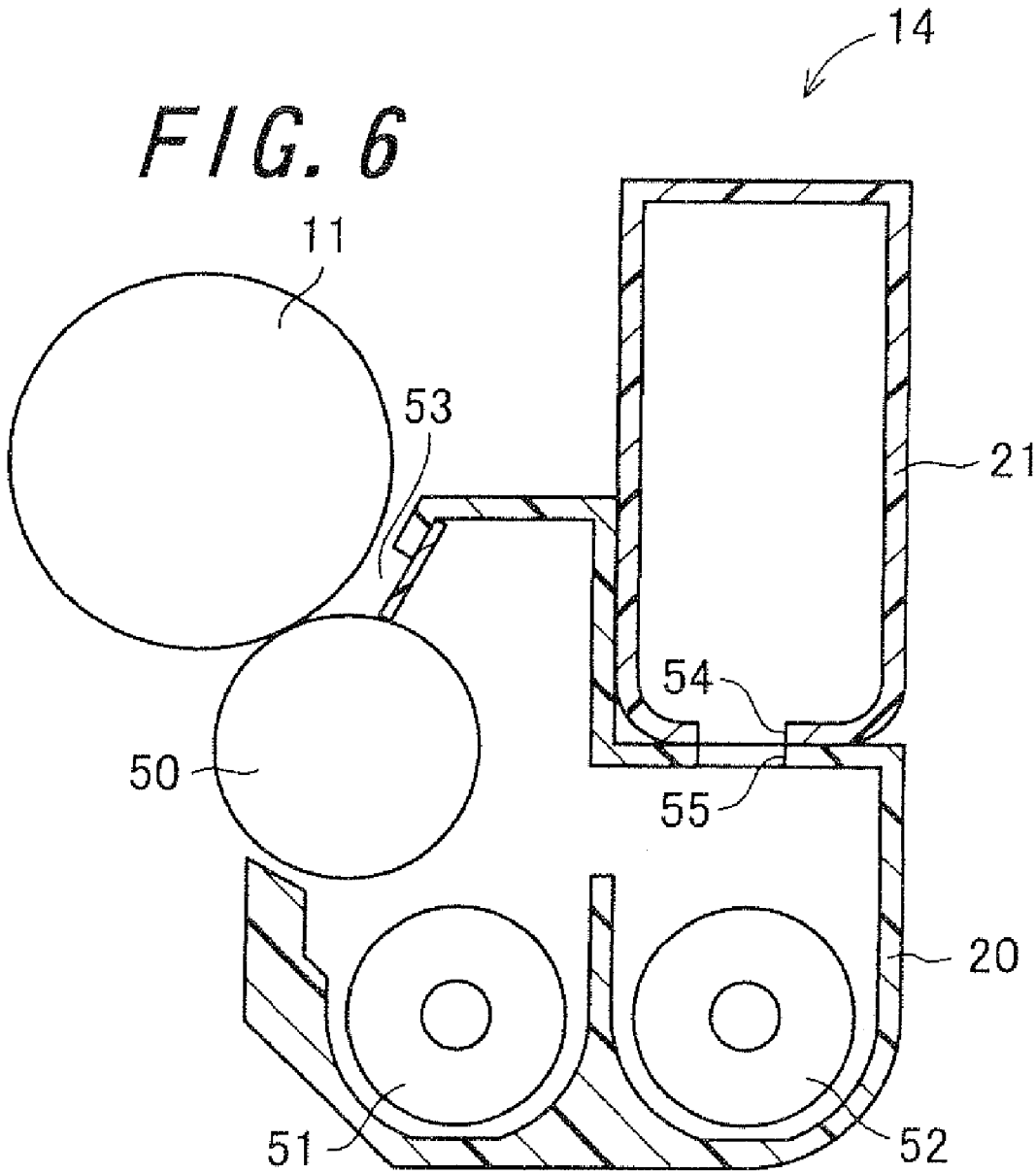
FIG. 6 is a schematic view schematically showing a developing section provided in the image forming apparatus shown in FIG. 5.

FIG. 6 is a schematic view schematically showing the developing section 14 provided in the image forming apparatus 100 shown in FIG. 5. The developing section 14 includes a developing tank 20 and a toner hopper 21.

The developing tank 20 is a container-shaped member which is disposed so as to face the surface of the photoreceptor drum 11 and used to supply a toner to an electrostatic latent image formed on the surface of the photoreceptor drum 11. The developing tank 20 contains in an internal space thereof the toner, and stores and rotatably supports roller members such as a developing roller 50, a supplying roller 51, and an agitating roller 52. Moreover, a screw member may be stored instead of the roller-like member. The developing section 14 of this embodiment stores the toner of the afore-mentioned one embodiment in the developing tank 20 as a toner.

The developing tank 20 has an opening 53 on a side face thereof opposed to the photoreceptor drum 11. The developing roller 50 is provided at a position facing the photoreceptor drum 11 through the opening 53 just stated. The developing roller 50 is a roller-shaped member for supplying the toner to the electrostatic latent image on the surface of the photoreceptor drum 11 in a pressure-contact portion or most-adjacent portion between the developing roller 50 and the photoreceptor drum 11. In supplying the toner, to a surface of the developing roller 50 is applied a potential whose polarity is opposite to the polarity of the potential of the charged toner, which serves as development bias voltage. By so doing, the toner on the surface of the developing roller 50 is smoothly supplied to the electrostatic latent image. Further, an amount of the toner being supplied to the electrostatic latent image, that is, a toner attachment amount to the electrostatic latent image, can be controlled by changing a value of the development bias voltage.

The supplying roller 51 is a roller-shaped member which is rotatably disposed so as to face the developing roller 50 and used to supply the toner to the vicinity of the developing roller 50. The agitating roller 52 is a roller-shaped member which is rotatably disposed so as to face the supplying roller 51 and used to feed to the vicinity of the supplying roller 51 the toner which is newly supplied from the toner hopper 21 into the developing tank 20. The toner hopper 21 is disposed so as to communicate a toner replenishment port 54 provided on a vertically lower part of the toner hopper 21, with a toner reception port 55 provided on a vertically upper part of the developing tank 20. The toner hopper 21 replenishes the developing tank 20 with the toner according to toner consumption. Further, it may be possible to adopt a configuration such that the developing section 14 is replenished with the toner supplied directly from a toner cartridge of each color without using the toner hopper 21.

As described above, since the developing section 14 develops a latent image by using the developer of the invention, it is possible to stably form a high-definition toner image on the photoreceptor drum 11, thereby it is possible to form a high-quality image stably.

The cleaning unit 15 removes the toner which remains on the surface of the photoreceptor drum 11 after the toner image which was formed on the surface of the photoreceptor drum 11 by the developing section 14 has been transferred to a recording medium, and thus cleans the surface of the photoreceptor drum 11. In the cleaning unit 15, for example, a platy member such as a cleaning blade is used. In the image forming apparatus 1 of the embodiment, an organic photoreceptor drum is used as the photoreceptor drum 11. A surface of the organic photoreceptor drum contains a resin component as a main ingredient and therefore tends to be degraded by chemical action of ozone which is generated by corona discharging of the charging section. The degraded surface part is, however, worn away by abrasion through the cleaning unit 15 and thus removed reliably, though gradually. Accordingly, the problem of the surface degradation caused by the ozone, etc. is solved, and it is thus possible to stably maintain the potential of charges over a long period of time. Although the cleaning unit 15 is provided in the embodiment, the cleaning unit 15 does not have to be particularly provided.

The transfer section 3 is disposed above the photoreceptor drum 11 and includes the intermediate transfer belt 25, a driving roller 26, a driven roller 27, four intermediate transfer rollers 28*b*, 28*c*, 28*m*, 28*y* corresponding to each color image information of black, cyan, magenta, and yellow, a transfer belt cleaning unit 29, and a transfer roller 30.

According to the transfer section 3, the toner image is transferred from the photoreceptor drum 11 onto the intermediate transfer belt 25 in the pressure-contact portion between the photoreceptor drum 11 and the intermediate transfer roller 28. After the transferred toner image is conveyed to a transfer nip region, the toner image is transferred onto the recording medium.

The intermediate transfer belt 25 is an endless belt which is supported around the driving roller 26 and the driven roller 27 with tension and forms a loop-shaped travel path. The intermediate transfer belt 25 rotates in a direction of the arrow B. The driving roller 26 is disposed so as to be capable of being rotated around its own axis by a drive section (not shown), and by the rotation of the driving roller 26 the intermediate transfer belt 25 rotates in the direction of the arrow B. The driven roller 27 is disposed so as to be capable of being driven to rotate by the rotation of the driving roller 26, and imparts constant tension to the intermediate transfer belt 25 so that the intermediate transfer belt 25 does not go slack. The intermediate transfer roller 28 is disposed in pressure-contact with the photoreceptor drum 11 with the intermediate transfer belt 25 interposed therebetween, and capable of being rotated around its own axis by a drive section (not shown). Further, the intermediate transfer roller 28 is connected to a power source (not shown) for applying transfer bias voltage, and transfers the toner image formed on the surface of the photoreceptor drum 11 to the intermediate transfer belt 25.

When the intermediate transfer belt 25 passes by the photoreceptor drum 11 in contact therewith, the transfer bias voltage whose polarity is opposite to the polarity of the charged toner on the surface of the photoreceptor drum 11 is applied from the intermediate transfer roller 28, with the result that the toner image formed on the surface of the photoreceptor drum 11 is transferred onto the intermediate transfer belt 25. The transferred toner image is conveyed to the transfer nip region by the rotation of the intermediate transfer belt 25 in the direction of the arrow B, where the toner image is transferred onto the recording medium. In case of a multicolor image, the toner images of respective colors formed on the respective photoreceptor drums 11 are sequentially transferred and overlaid onto the intermediate transfer belt 25, thus forming a multicolor toner image.

The transfer belt cleaning unit 29 is disposed opposite to the driven roller 27 with the intermediate transfer belt 25 interposed therebetween so as to be in contact with an cuter circumferential surface of the intermediate transfer belt 25. When the intermediate transfer belt 25 contacts the photoreceptor drum 11, the toner is attached to the intermediate transfer belt 25 and may cause contamination on the recording medium, and therefore the transfer belt cleaning unit 29 removes and collects the toner on the surface of the intermediate transfer belt 25.

The transfer roller 30 is disposed in pressure-contact with the driving roller 26 with the intermediate transfer belt 25 interposed therebetween, and capable of being rotated around its own axis by a drive section (not shown). In a pressure-contact portion (the transfer nip region) between the transfer roller 30 and the driving roller 26, a toner image which has been borne by the intermediate transfer belt 25 and thereby conveyed to the pressure-contact portion is transferred onto a recording medium fed from the later-described recording medium feeding section 5. The recording medium onto which the toner image has been transferred is fed to the fixing section 4.

The fixing section 4 is provided downstream of the transfer section 3 along a conveyance direction of the recording medium, and contains a fixing roller 31 and a pressure roller 32. In the fixing section 4, the recording medium onto which the toner image has been transferred in the transfer section 3 is nipped by the fixing roller 31 and the pressure roller 32 so that when the recording medium passes through a fixing nip region, the toner image is heated and pressed and thereby fixed onto the recording medium. Accordingly, an image is formed.

The fixing roller 31 is disposed so as to be capable of being rotated by a drive section (not shown), and heats and fuses the toner.

Inside the fixing roller 31 is provided a heating section (not shown). The heating section heats the fixing roller 31 so that a surface of the fixing roller 31 has a predetermined temperature (hereinafter also referred to as "heating temperature"). As the heating section, a heater, a halogen lamp, and the like device can be used, for example. The heating section is controlled by a fixing condition control section. In the vicinity of the surface of the fixing roller 31 is provided a temperature detecting sensor (not shown) which detects a surface temperature of the fixing roller 31. A result detected by the temperature detecting sensor is written in a memory portion of the control unit mentioned below.

The pressure roller 32 is disposed in pressure-contact with the fixing roller 31, and supported so as to be driven to rotate by the rotation of the fixing roller 31. The pressure roller 32 fixes the toner image onto the recording medium in cooperation with the fixing roller 31. At this time, the pressure roller 32 assists in the fixation of the toner image onto the recording medium by pressing the toner in a fused state due to heat from the fixing roller 31, against the recording medium. A pressure-contact portion between the fixing roller 31 and the pressure roller 32 is the fixing nip region.

The recording medium feeding section 5 includes an automatic paper feed tray 35, a pickup roller 36, conveying rollers 37, registration rollers 38, and a manual paper feed tray 39. In the recording medium feeding section 5, the recording medium supplied sheet by sheet from the automatic paper feed tray 35 or the manual paper feed tray 39 is fed to the transfer nip region in synchronization with the conveyance of the toner image borne on the intermediate transfer belt 25 to the transfer nip region.

The automatic paper feed tray 35 is disposed in a vertically lower part of the image forming apparatus 100 and in the form of a container-shaped member for storing the recording mediums. Examples of the recording medium include plain paper, color copy paper, sheets for overhead projector, and postcards. The pickup roller 36 takes out sheet by sheet the recording mediums stored in the automatic paper feed tray 35, and feeds the recording mediums to a paper conveyance path a1. The conveying rollers 37 are a pair of roller members disposed in pressure-contact with each other, and convey the recording medium to the registration rollers 38. The registration rollers 38 are a pair of roller members disposed in pressure-contact with each other, and feed to the transfer nip region the recording medium fed from the conveying rollers 37 in synchronization with the conveyance of the toner image borne on the intermediate transfer belt 25 to the transfer nip region.

The manual paper feed tray 39 is a device for taking recording mediums into the image forming apparatus 1. The recording mediums stored in the manual paper feed tray 39 are different from those stored in the automatic paper feed tray 35, and may have any size. The recording medium taken in from the manual paper feed tray 39 is passed through a paper conveyance path a2 by the conveying rollers 37, thereby being fed to the registration rollers 38.

The discharging section 6 includes conveying rollers 37, discharging rollers 40, and a catch tray 41. The conveying rollers 37 are disposed downstream of the fixing nip region along the paper conveyance direction, and convey toward the discharging rollers 40 the recording medium onto which the image has been fixed by the fixing section 4. The discharging rollers 40 discharge the recording medium onto which the image has been fixed, to the catch tray 41 disposed on a vertically upper surface of the image forming apparatus 100. The catch tray 41 stores the recording medium onto which the image has been fixed.

The image forming apparatus 100 includes a control unit (not shown). The control unit is disposed, for example, in an upper part of an internal space of the image forming apparatus 100, and contains a memory portion, a computing portion, and a control portion.

To the memory portion are input, for example, various set values obtained by way of an operation panel (not shown) disposed on the upper surface of the image forming apparatus 100, results detected from a sensor (not shown) etc. disposed in various portions inside the image forming apparatus 100, and image information obtained from an external equipment. Further, programs for operating various functional elements are written, examples of the various functional elements include a recording medium determining section, an attachment amount control section, and a fixing condition control section. As the memory portion, those customarily used in the relevant field can be used including, for example, a read only memory (ROM), a random access memory (RAM), and a hard disk drive (HDD). As the external equipment, it is possible to use electrical and electronic devices which can form or obtain the image information and which can be electrically connected to the image forming apparatus 100. Examples of the external equipment include a computer, a digital camera, a television receiver, a video recorder, a DVD recorder, an HD DVD, a Blu-ray disc recorder, a facsimile machine, and a personal digital assistant.

The computing portion takes out the various data (such as an image formation order, the detected result, and the image information) written in the memory portion and the programs for the various functional elements, and then makes various determinations.

The control portion sends to a relevant device a control signal in accordance with the result determined by the computing portion, thus performing control on operations. The control portion and the computing portion include a processing circuit which is achieved by a microcomputer, a microprocessor and the like having a central processing unit (CPU). The control unit contains a main power source as well as the afore-mentioned processing circuit. The power source supplies electricity to not only the control unit but also respective devices provided inside the image forming apparatus 100.

EXAMPLES

Hereinafter, referring to examples and comparative examples, the invention will be specifically described. In the following description, unless otherwise noted, "part(s)" and "%" represent "part(s) by weight" and "% by weight", respectively. In the examples and the comparative examples, glass transition temperature of the binder resin and the toner base particles, softening temperature of the resin, melting point of the release agent, volume average particle size of the toner base particles and storage elastic modulus were measured as follows.

[Glass Transition Temperature of Binder Resin and Toner Base Particle]

Using a differential scanning calorimeter (trade name: DSC220, manufactured by Seiko Instruments & Electronics Ltd.), 1 g of specimen was heated at a temperature increasing rate of 10° C./rain to measure a DSC curve based on Japanese Industrial Standards (JIS) K7121-1987, A temperature at an intersection of a straight line that was extended toward a low-temperature side from a base line on the high-temperature side of an endothermic peak corresponding to glass transition of the obtained DSC curve and a tangent line that was drawn on a point where a gradient thereof was maximum against a curve extending from a rising part to a top of the peak was regarded as the glass transition temperature ($T_g$).

[Softening Temperature]

Using a flow characteristic evaluation apparatus (trade name: FLOW TESTER CFT-100C, manufactured by Shimadzu Corporation), 1 g of specimen was heated at a temperature increasing rate of 6° C./min, and a load of 20 kgf/cm$^2$ ($19.6\times10^5$Pa) is applied thereto. A temperature at the time when a half-amount of the specimen was pushed out of a dye (nozzle opening diameter of 1 mm and length of 1 mm) was obtained as the softening temperature ($T_m$).

[Melting Point of Release Agent]

Using the differential scanning calorimeter (trade name; DSC220, manufactured by Seiko Instruments & Electronics Ltd.), 1 g of specimen was heated from a temperature of 20° C. up to 200° C. at a temperature increasing rate of 10° C./min, and then an operation of rapidly cooling down from 200° C. to 20° C. was repeated twice, thus measuring a DSC curve. A temperature of an endothermic peak corresponding to the melting on the DSC curve measured at the second operation was regarded as the melting point of the release agent.

[Volume Average Particle Size]

To 50 ml of electrolyte (trade name: ISOTON-II, manufactured by Beckman Coulter, Inc.), 20 mg of specimen and 1 ml of sodium alkylether sulfate were added, and a thus-obtained mixture was subjected to dispersion processing by an ultrasonic distributor (trade name: desktop two-frequency ultrasonic cleaner VS-D100, manufactured by AS ONE Corporation) for three minutes at an ultrasonic frequency of 20 kHz, thereby preparing a measurement sample. The measurement sample was analyzed by a particle size distribution-measuring device: MULTISIZER III (trade name, manufactured by Beckman Coulter, Inc.) under the conditions where an aperture diameter was 100 μm and the number of particles for measurement was 50,000 counts. A volume particle size distribution of the sample particles was thus obtained from which the volume average particle size was then determined.

[Storage Elastic Modulus]

A tablet with 1 mm in height into which the toner base particles or the fine resin particles were fabricated was set on a parallel plate with 25 mm in diameter, and heated from 70° C. to 150° C. at an increasing temperature of 3° C./min with the use of a temperature-elevating process by a viscoelasticity measuring device: VAR-100 (trade name, manufactured by REOLOGICA Instruments, Inc) under the conditions where an ultrasonic frequency is 1 Hz and a deformation is 0.5. Storage elastic modulus G' was thus obtained.

Example 1

[Toner Base Particle Producing Step S1]

| | |
|---|---|
| Polyester resin (trade name: DIACRON, manufactured by Mitsubishi Rayon Co., Ltd., glass transition temperature of 55° C., softening temperature of 130° C.) | 87.5% (100 parts) |
| C.I. Pigment Blue 15:3 | 5.0% (5.7 parts) |
| Release agent (paraffin wax, melting point of 75° C.) | 6.0% (6.9 parts) |
| Charge control agent (trade name: Bontron E84, manufactured by Orient Chemical Industries, Ltd.) | 1.5% (1.7 parts) |

After pre-mixing the afore-mentioned materials by Henschel mixer (trade name: FM20C, manufactured by Mitsui Mining Co., Ltd.), the obtained mixture was melt and kneaded by KNEADEX (trade name, manufactured by Mitsui Mining Co., Ltd.) at 140° C. After coarsely pulverizing the melt-kneaded material by a cutting mill (trade name: VM-16, manufactured by Orient Co., Ltd.), it was finely pulverized by a jet mill (manufactured by Hosokawa Micron Corporation) and then classified by a pneumatic classifier (manufactured by Hosokawa Micron Corporation) to produce toner base particles with a volume average particle size of 6.5 μm, a glass transition temperature of 56° C. and a softening temperature of 125° C. The storage elastic modulus G' of the toner base particles at a softening temperature of 125° C. was $1.2\times10^3$Pa.

[Fine Resin Particle Preparing Step S2]

(Preparing of Fine Resin Particle A)

Polymer of styrene and butyl acrylate was freeze-dried, thereby obtaining styrene butyl acrylate copolymer fine resin particles A (glass transition temperature of 61° C. and softening temperature of 110° C.) with a volume average particle size of 0.1 μm. The molecular weight (weight average) of the fine resin particles A was 15,500, and the storage elastic modulus G' thereof at 125° C. was $2.1\times10^3$Pa.

[Coating Step S3]

By an apparatus in which a two-fluid nozzle is installed in a hybridization system (trade name: NHS-1 Model, manufactured by Nara Machinery Co., Ltd.) in accordance with the apparatus shown in FIG. 2, the toner base particles and the fine resin particles were stirred and fluidized, to which ethanol was then sprayed. As a liquid spraying unit, a product is usable that connects a liquid feeding pump (trade name: SP11-12, manufactured by FLOM Co., Ltd.) and a two-fluid nozzle so as to allow a constant-flow feeding. The spraying speed of liquid and the exhausting speed of liquid gas can be observed with a commercially available gas detector (product name: XP-3110, manufactured by New Cosmos electric Co., Ltd.).

The temperature regulation jacket was provided over the entire surface of the powder flowing section and the wall face of the stirring section. A temperature sensor was installed in the powder passage, and a temperature of the powder flowing section and the stirring section was adjusted to 55° C. In the above apparatus, a peripheral speed in the outermost peripheral of the rotary stirring section of the Hybridization system was 100 m/sec at the fine resin particle adhering step to the surface of toner base particles. The peripheral speed was also 100 m/sec at the spraying step and the film-forming step. Moreover, an installation angle of the two-fluid nozzle was set so that an angle formed by the liquid spraying direction and the powder flowing direction (hereinafter referred to as "spraying angle") is in parallel)(0°).

By such an apparatus, after stirring and mixing 100 parts by weight of the toner base particles and 7 parts by weight of the fine resin particles A for five minutes, ethanol was sprayed for thirty minutes at spraying speed of 0.5 g/min and an air flow of 5 L/min to film-form the fine resin particles A on the surface of the toner base particles. Spraying of the ethanol was stopped, followed by stirring for five minutes, to obtain the capsule toner of Example 1. In this case, an exhaust concentration of the liquid exhausted through the through-hole and the gas exhausting section was stable at about 1.4 Vol %. Moreover, the air flow into the apparatus was 10 L/min in total with the air flow from the two-fluid nozzle by adjusting the air flow from the rotary shaft section into the apparatus to 5 L/min.

Example 2

(Preparing of Fine Resin Particle B)

Styrene butyl acrylate copolymer fine resin particles B (glass transition temperature of 62° C. and softening temperature of 112° C.) with a volume average particle size of 0.1 μm were obtained in the same manner as the fine resin particles A except that the polymerization condition of styrene and butyl acrylate was changed. A molecular weight (weight average) of the fine resin particles B was 17,200, and the storage elastic modulus G' thereof at 125° C. was $2.4\times10^3$Pa.

A toner of Example 2 was obtained in the same manner as Example 1 except that the fine resin particles A are changed to the fine resin particles B.

Example 3

(Preparing of Fine Resin Particle C)

Styrene butyl acrylate copolymer fine resin particles C (glass transition temperature of 60° C. and softening temperature of 115° C.) with a volume average particle size of 0.1 μm were obtained in the same manner as the fine resin particles A except that the polymerization condition of styrene and butyl acrylate was changed. A molecular weight (weight average) of the fine resin particles C was 18,200, and the storage elastic modulus G' thereof at 125° C. was $4.1\times10^3$Pa.

A toner of Example 3 was obtained in the same manner as Example 1 except that the fine resin particles A are changed to the fine resin particles C.

Example 4

A toner of Example 4 was obtained in the same manner as Example 1 except that an addition amount of the fine resin particles A are changed to be 4.0 parts.

Example 5

(Preparing of Fine Resin Particle D)

Styrene butyl acrylate copolymer fine resin particles D (glass transition temperature of 58° C. and softening temperature of 111° C.) with a volume average particle size of 0.1 μm were obtained in the same manner as the fine resin particles A except that the polymerization condition of styrene and butyl acrylate was changed. A molecular weight (weight average) of the fine resin particles D was 13,400, and the storage elastic modulus G' thereof at 125° C. was $3.0\times10^3$Pa.

A toner of Example 5 was obtained in the same manner as Example 1 except that the fine resin particles A are changed to the fine resin particles D.

Example 6

A toner of Example 6 was obtained in the same manner as Example 5 except that an addition amount of the fine resin particles D are changed to be 4.0 parts.

Example 7

(Preparing of Fine Resin Particle E)

Styrene butyl acrylate copolymer fine resin particles E (glass transition temperature of 59° C. and softening temperature of 108° C.) with a volume average particle size of 0.1 μm were obtained in the same manner as the fine resin particles A except that the polymerization condition of styrene and butyl acrylate was changed. A molecular weight (weight average) of the fine resin particles E was 14,800, and the storage elastic modulus G' thereof at 125° C. was $2.0\times10^3$Pa.

A toner of Example 7 was obtained in the same manner as Example 1 except that the fine resin particles A are changed to the fine resin particles E.

Example 8

A toner of Example 8 was obtained in the same manner as Example 7 except that an addition amount of the fine resin particles E are changed to be 4.0 parts.

Comparative Example 1

(Preparing of Fine Resin Particle F)

Styrene butyl acrylate copolymer fine resin particles F (glass transition temperature of 61° C. and softening temperature of 114° C.) with a volume average particle size of 0.1 μm were obtained in the same manner as the fine resin particles A except that the polymerization condition of styrene and butyl acrylate was changed. A molecular weight (weight average) of the fine resin particles F was 21,300, and the storage elastic modulus G' thereof at 125° C. was $4.3\times10^3$Pa.

A toner of Comparative Example 1 was obtained in the same manner as Example 1 except that the fine resin particles A are changed to the fine resin particles F.

Comparative Example 2

(Preparing of Fine Resin Particle G)

Styrene butyl acrylate copolymer fine resin particles G (glass transition temperature of 62° C. and softening temperature of 116° C.) with a volume average particle size of 0.1 μm were obtained in the same manner as the fine resin particles A except that the polymerization condition of styrene and butyl acrylate was changed. A molecular weight (weight average) of the fine resin particles G was 25,400, and the storage elastic modulus G' thereof at 125° C. was $13.2\times10^3$Pa.

A toner of Comparative Example 2 was obtained in the same manner as Example 1 except that the fine resin particles A are changed to the fine resin particles G.

Comparative Example 3

(Preparing of Fine Resin Particle H)

Styrene butyl acrylate copolymer fine resin particles H (glass transition temperature of 55° C. and softening temperature of 106° C.) with a volume average particle size of 0.1 μm were obtained in the same manner as the fine resin particles A except that the polymerization condition of styrene and butyl acrylate was changed. A molecular weight (weight average) of the fine resin particles H was 13,300, and the storage elastic modulus G' thereof at 125° C. was $1.0\times10^3$Pa.

A toner of Comparative Example 3 was obtained in the same manner as Example 1 except that the fine resin particles A are changed to the fine resin particles H.

Comparative Example 4

A toner of Comparative Example 4 was obtained only from the toner base particles without performing the coating step S3.

Evaluations were conducted as follows for the obtained toners of Examples 1 to 8 and Comparative Examples 1 to 4.

[Fixing Property]

Fixed images by two-component developers comprising each toner of Examples and Comparative Examples, respectively were produced by using a modified commercially-available copier (trade name: MX-4500, manufactured by Sharp Corporation). First of all, a sample image including a solid image part (in a rectangular shape of 20 mm in length and 50 mm in width) was formed as an unfixed image onto a recording sheet (trade name; PPC paper SF-4AM3, manufactured by Sharp Corporation) which is a recording medium. On this occasion, an attachment amount of the toner of the solid image part onto the recording sheet was adjusted to 0.5 mg/cm$^2$. Next, a fixed image was produced by use of an external fixing machine, which used a fixing section of a color multifunctional peripheral. A fixing process rate was set up at 124 mm/sec, the temperature of the fixing roller was raised at intervals of 5° C. from 130° C., and a temperature region where neither low-temperature offset nor hot-temperature offset took place was measured. The temperature region was defined as a non-offset fixing region. In the embodiment, the hot-temperature offset and the low-temperature offset mean that the toner is not fixed onto a recording sheet during fixing but is attached onto the recording sheet after the fixing roller goes round with the toner kept to adhere to the fixing roller.

The fixing property was evaluated based on the following standard:

Excellent; Very favorable. A non-offset fixing region is 50° C. or higher.

Good: Favorable. A non-offset fixing region is higher than 35° C. and lower than 50° C.

Somewhat bad: Not so favorable. A non-offset fixing region is higher than 25° C. and 35° C. or lower.

Poor: No good. A non-offset fixing region is 25° C. or lower.

[Preservation Stability]

The preservation stability was evaluated based on presence/absence of an aggregate after high-temperature storage by using the toners of Examples and Comparative Examples. After 20 g of the toner was sealed in a plastic container and left for 72 hours at 60° C., the toner was taken out and passed through a 230-mesh sieve. The weight of the toner remaining on the sieve was measured and the remaining amount which was a ratio of the weight to the total weight of the toner was obtained to perform the evaluation based on the following standard. The lower value shows that the toner is not blocked and preservability is excellent.

Excellent: Very favorable. The remaining amount of the toner is less than 1%.

Good: Favorable. The remaining amount of the toner is 1% or more and less than 3%.

Somewhat bad: Not so favorable. The remaining amount of the toner is 3% or more and less than 20%.

Poor: No good. The remaining amount of the toner is 20% or more.

(Comprehensive Evaluation)

A comprehensive evaluation was conducted for the capsule toner of the invention based on the evaluations of the above fixing property and preservation stability. Evaluation standard is as follows.

Excellent: Very favorable. Both evaluation results are "Excellent".

Good: Favorable. Evaluation results are "Excellent" or "Good"

Somewhat bad: Not so favorable. Either evaluation result is "A little bad, but "Poor" was not given.

Poor; No good. Either evaluation result is "Poor", or both evaluation results are "Somewhat bad".

Table 1 shows the physicality of the fine resin particles used in the toner of Examples 1 to 8 and Comparative Examples 1 to 4, and Table 2 shows the evaluation results of the obtained toner.

TABLE 1

| | Fine resin particle | Difference of storage elastic modulus G' from that of toner base particle at 125° C. [Pa] | Addition amount based on 100 of toner base particle [parts by weight] | Tg [° C.] |
|---|---|---|---|---|
| Example 1 | A | $0.9 \times 10^3$ | 7 | 61 |
| Example 2 | B | $1.2 \times 10^3$ | 7 | 62 |
| Example 3 | C | $2.9 \times 10^3$ | 7 | 60 |
| Example 4 | A | $0.9 \times 10^3$ | 4 | 61 |
| Example 5 | D | $1.8 \times 10^3$ | 7 | 58 |
| Example 6 | D | $1.8 \times 10^3$ | 4 | 58 |
| Example 7 | E | $0\ 8 \times 10^3$ | 7 | 59 |
| Example 8 | E | $0.8 \times 10^3$ | 4 | 59 |
| Comparative Example 1 | E | $3.1 \times 10^3$ | 7 | 61 |
| Comparative Example 2 | F | $12.0 \times 10^3$ | 7 | 62 |
| Comparative Example 3 | H | $-0.2 \times 10^3$ | 7 | 55 |
| Comparative Example 4 | None | — | — | — |

TABLE 2

| | Fixing property | | Preservation stability | | |
|---|---|---|---|---|---|
| | Non-offset fixing region [° C.] | Evaluation | Remaining amount of toner [%] | Evaluation | Comprehensive evaluation |
| Example 1 | 55 | Excellent | Nearly 0 | Excellent | Excellent |
| Example 2 | 45 | Good | Nearly 0 | Excellent | Good |
| Example 3 | 45 | Good | Nearly 0 | Excellent | Good |
| Example 4 | 55 | Excellent | 1.5 | Good | Good |
| Example 5 | 55 | Excellent | 1.9 | Good | Good |
| Example 6 | 55 | Excellent | 2.7 | Good | Good |
| Example 7 | 55 | Excellent | 1.8 | Good | Good |
| Example 8 | 55 | Excellent | 2.8 | Good | Good |
| Comparative Example 1 | 35 | Somewhat bad | Nearly 0 | Excellent | Somewhat bad |
| Comparative Example 2 | 25 | Poor | Nearly 0 | Excellent | Poor |
| Comparative Example 3 | 55 | Excellent | 43 | Poor | Poor |
| Comparative Example 4 | 55 | Excellent | 34 | Poor | Poor |

The toners of Examples 1 to 8 were very favorable or favorable in both evaluations of the fixing property and the preservation stability.

The toners of Comparative Examples 1 and 2 were not so favorable or no good in an evaluation of the fixing property. This was because, although the fine resin particles formed a film on the toner base particle so as to form a resin layer, a difference between the storage elastic modulus of the toner base particles and the storage elastic modulus of the fine resin particles was large, and even when a release agent melted during fixing, the resin layer became a wall, thereby exudation of the release agent was not so easy that high-temperature offset phenomenon easily occurred.

The toner of Comparative Example 3 was very favorable in the fixing property but no good in the preservation stability.

This was because, although the fine resin particles formed a film on the toner base particle so as to form a resin layer, the storage elastic modulus of the fine resin particles was smaller than that of the toner base particles.

The toner of Comparative Example 4 was very favorable in the fixing property but no good in the preservation stability, because the toner base particles were not coated with the fine resin particles.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. A capsule toner comprising a toner base particle and a resin layer formed of fine resin particles with which a surface of the toner base particle is coated, both of the following expressions being satisfied:

$$A<B;\ \text{and}\ (B-A)<3\times10^3 Pa \quad (1)$$

where A is a storage elastic modulus of the toner base particle at a softening temperature of the toner base particle, B is a storage elastic modulus of the fine resin particle at the softening temperature of the toner base particle, and both A and B are $1.0\times10^2$ Pa or more and less than $5.0\times10^4$ Pa.

2. The capsule toner of claim 1, wherein the storage elastic modulus A and the storage elastic modulus B satisfy both of the following expressions:

$$A<B;\ \text{and}\ (B-A)<1\times10^3 Pa \quad (2).$$

3. The capsule toner of claim 1, wherein the capsule toner is manufactured by a method comprising a fine resin particle adhering step of adhering the fine resin particles to the surface of the toner base particle which has been produced through a pulverization method, a spraying step of spraying a liquid with carrier gas from a spraying section to the toner base particle and the fine resin particles in a fluidized state to plasticize these particles, and a film-forming step of continuing rotating by a rotary stirring section to fluidize the toner base particle and the fine resin particles until the fine resin particles adhered to the toner base particle are softened to form a film.

4. The capsule toner of claim 3, wherein an addition amount of the fine resin particle at the fine resin particle adhering step is 5 parts by weight or more based on 100 parts by weight of the toner base particle.

5. The capsule toner of claim 1, wherein a glass transition temperature of the fine resin particle is 60° C. or higher.

6. A two-component developer comprising the capsule toner of claim 1 and a carrier.

* * * * *